US008631529B1

(12) United States Patent
Johnson et al.

(10) Patent No.: US 8,631,529 B1
(45) Date of Patent: Jan. 21, 2014

(54) OPERABLE STEP

(71) Applicants: David Johnson, Modesto, CA (US); Donald Morris, Littleton, CO (US)

(72) Inventors: David Johnson, Modesto, CA (US); Donald Morris, Littleton, CO (US)

(73) Assignee: Lift-U, division of Hogan Mfg., Inc., Escalon, CA (US)

( * ) Notice: Subject to any disclaimer, the term of this patent is extended or adjusted under 35 U.S.C. 154(b) by 0 days.

(21) Appl. No.: 13/668,096

(22) Filed: Nov. 2, 2012

Related U.S. Application Data

(60) Provisional application No. 61/554,943, filed on Nov. 2, 2011.

(51) Int. Cl.
*E01D 1/00* (2006.01)

(52) U.S. Cl.
USPC ..... 14/71.3; 414/921

(58) Field of Classification Search
USPC ..... 14/71.1, 71.3; 414/921
See application file for complete search history.

(56) References Cited

U.S. PATENT DOCUMENTS 4,022,337 A * 5/1977 Eichenhofer et al. ..... 414/541
4,027,807 A * 6/1977 Thorley ..... 414/545
4,081,091 A * 3/1978 Thorley ..... 414/545
4,124,096 A * 11/1978 Dudynskyj et al. ..... 414/539
4,124,098 A * 11/1978 Dudynskyj ..... 414/546
4,124,099 A * 11/1978 Dudynskyj ..... 414/546
4,164,292 A * 8/1979 Karkau ..... 414/545
4,176,999 A * 12/1979 Thorley ..... 414/540
4,180,366 A * 12/1979 Roth et al. ..... 414/540
4,251,179 A * 2/1981 Thorley ..... 414/545
4,270,630 A * 6/1981 Karkau ..... 187/200
4,285,416 A * 8/1981 Dudynskyj ..... 414/540
4,559,659 A * 12/1985 Hunter, Jr. ..... 14/71.3
4,583,466 A * 4/1986 Reddy et al. ..... 105/447
5,230,288 A * 7/1993 Bickel ..... 105/425
5,284,414 A * 2/1994 Kempf ..... 414/545
5,316,432 A * 5/1994 Smalley et al. ..... 414/540
5,425,615 A * 6/1995 Hall et al. ..... 414/545
5,439,342 A * 8/1995 Hall et al. ..... 414/545
5,454,196 A * 10/1995 Gaines et al. ..... 52/183
6,764,123 B1 * 7/2004 Bilyard ..... 296/61

* cited by examiner

*Primary Examiner* — Gary Hartmann
(74) *Attorney, Agent, or Firm* — Christensen O'Connor Johnson Kindness PLLC

(57) ABSTRACT

A step assembly provides access between a lift platform and an alighting surface. The step assembly includes a tread and a panel rotatably connected to the tread about a first axis. An actuator assembly is operably coupled to the panel to selectively move the step assembly between a raised position and a lowered position. In the raised position, the tread is substantially horizontal, and the panel is orthogonal to the tread. In the lowered position, the tread and the panel are substantially parallel and form a predetermined angle with respect to a horizontal plane.

15 Claims, 31 Drawing Sheets

OPERABLE STEP

CROSS-REFERENCE TO RELATED APPLICATION

This application claims the benefit of U.S. Provisional Application No. 61/554,943, filed Nov. 2, 2011, the disclosure of which is expressly incorporated by reference.

TECHNOLOGY FIELD OF THE INVENTION

The present disclosure is generally directed to an operable step for use with low-rise vertical platform lifts. These low-rise vertical platform lifts can be used in architectural installations, such as but not limited to courtrooms, churches, and meeting chambers, which traditionally have sensitive building interior aesthetics. The described embodiments include an operable step that is selectively moveable between a raised step position and a lowered ramp position.

SUMMARY

In accordance with aspects of the present disclosure, a first embodiment of a step assembly provides access between a lift platform and an alighting surface. The step assembly includes a tread and a panel rotatably connected to the tread about a first axis. An actuator assembly is operably coupled to the panel to selectively move the step assembly between a raised position and a lowered position. In the raised position, the tread is substantially horizontal, and the panel is orthogonal to the tread. In the lowered position, the tread and the panel are substantially parallel and form a predetermined angle with respect to a horizontal plane.

A second embodiment of a step assembly provides access between a lift platform and an alighting surface, wherein the lift platform is moveable between a first elevation and a second elevation, the first elevation being higher than the second elevation. The step assembly includes a tread, a panel rotatably coupled to the tread, and an actuator operably coupled to the panel. The actuator is configured to selectively move the step assembly between a raised position and a lowered position. In the raised position, the tread is substantially horizontal and positioned intermediate to the alighting surface and the first elevation of the lift platform when the step assembly is in the raised position. In the lowered position, the tread and the panel are substantially parallel and form a transition surface between the alighting surface and the second elevation of the lift platform.

In a third embodiment, the step assembly includes a tread and an actuator. The actuator is operably coupled to the tread and configured to selectively reciprocate the tread between a raised position and a lowered position. The actuator is rotatably coupled to the actuator mount, which is slidably coupled to a frame. A spring selectively maintains a position of the actuator mount relative to the frame.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Exemplary embodiments of the presently disclosed step assembly will now be described with reference to the accompanying drawings where like numerals correspond to like elements. Exemplary embodiments of the disclosed subject matter are directed to operable steps, and more specifically, to step assemblies that are selectively moveable between a raised "step" position and a lowered "ramp" position. In particular, several embodiments of the present invention are directed to operable steps for use with low-rise platform lifts installed in locations in which aesthetics and architectural integrity are required. Examples of such locations include but are not limited to courtrooms, churches, and meeting chambers, which traditionally have sensitive building interior aesthetics.

The following discussion proceeds with reference to examples of operable steps suitable for use with low-rise platform lifts. While the examples provided herein have been described with reference to their association with low-rise platform lifts, it will be apparent to one skilled in the art that this is done for illustrative purposes and should not be construed as limiting the scope of the disclosed subject matter, as claimed. Thus, it will be apparent to one skilled in the art that aspects of the disclosed operable step may be employed with other lifts used in stationary installations, such as residential buildings and the like.

The following detailed description may use illustrative terms such as higher, lower, vertical, horizontal, front, rear, proximal, distal, etc.; however, these terms are descriptive in nature and should not be construed as limiting. Further, it will be appreciated that embodiments of the disclosed subject matter may employ any combination of features described herein.

Figure 1:
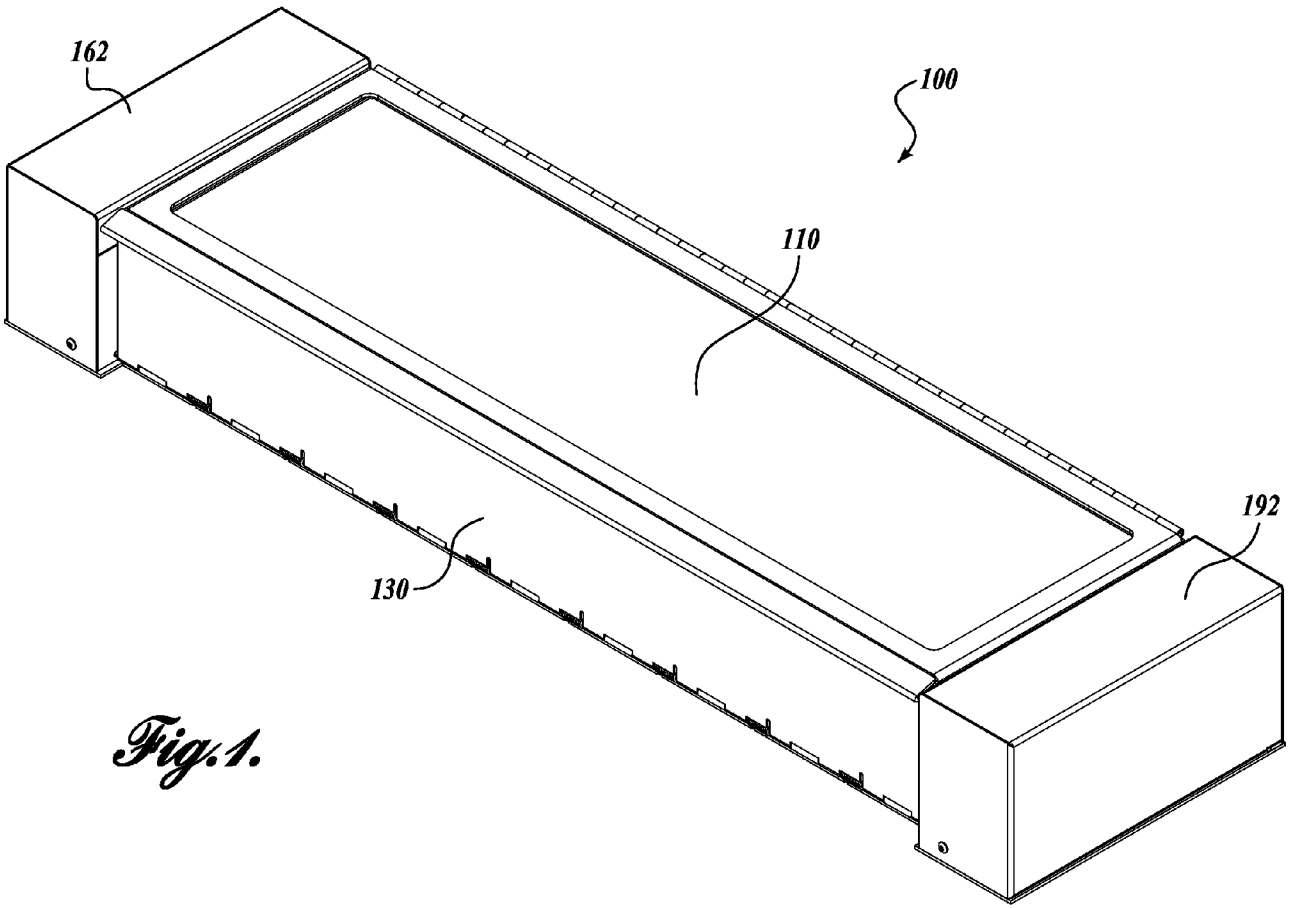
FIG. 1 is a front isometric view of an exemplary embodiment of a step assembly, wherein the step assembly is in a raised position.
Figure 2:
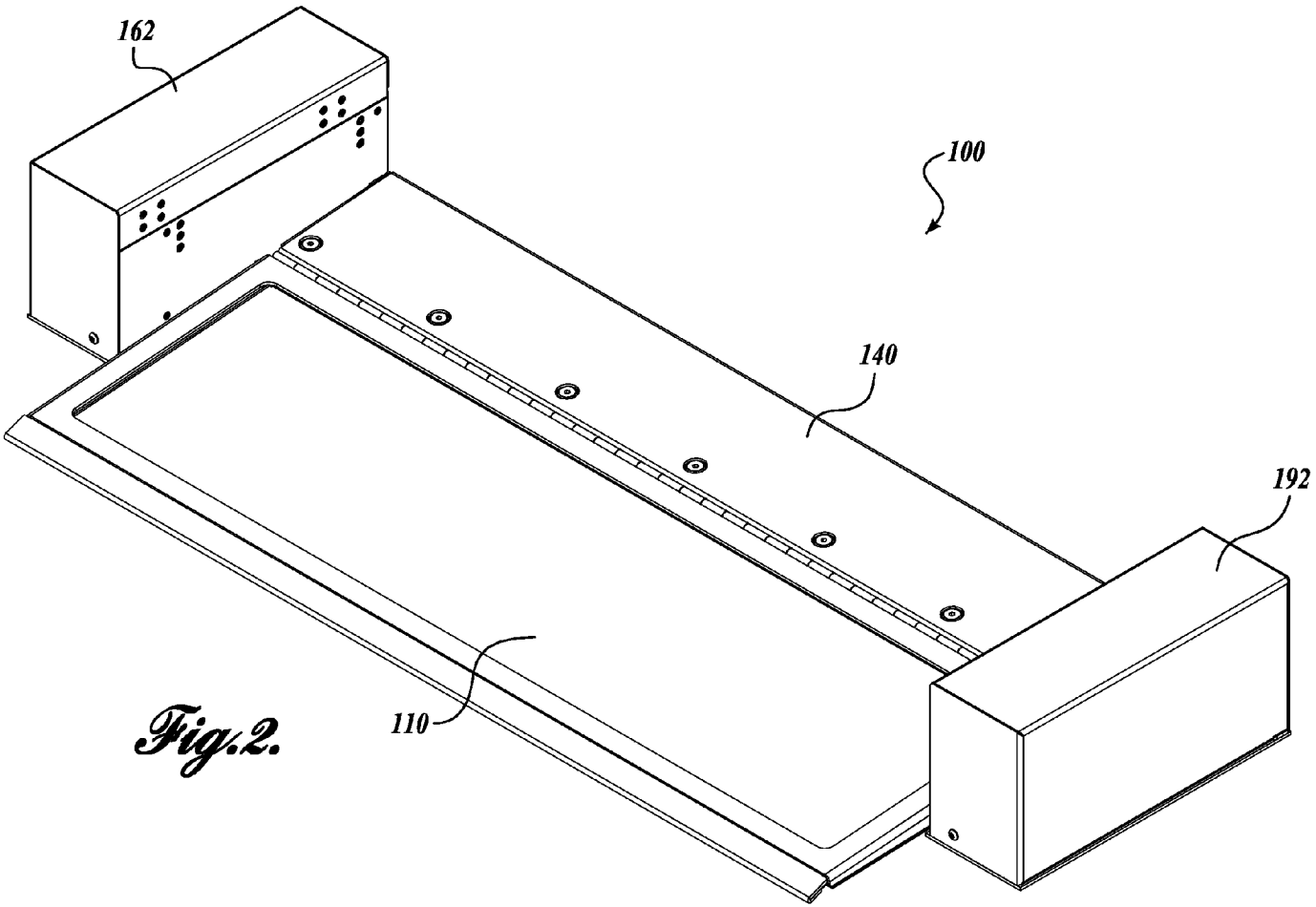
FIG. 2 is a front isometric view of the step assembly shown in FIG. 1, wherein the step assembly is in a lowered position.
Figure 3:
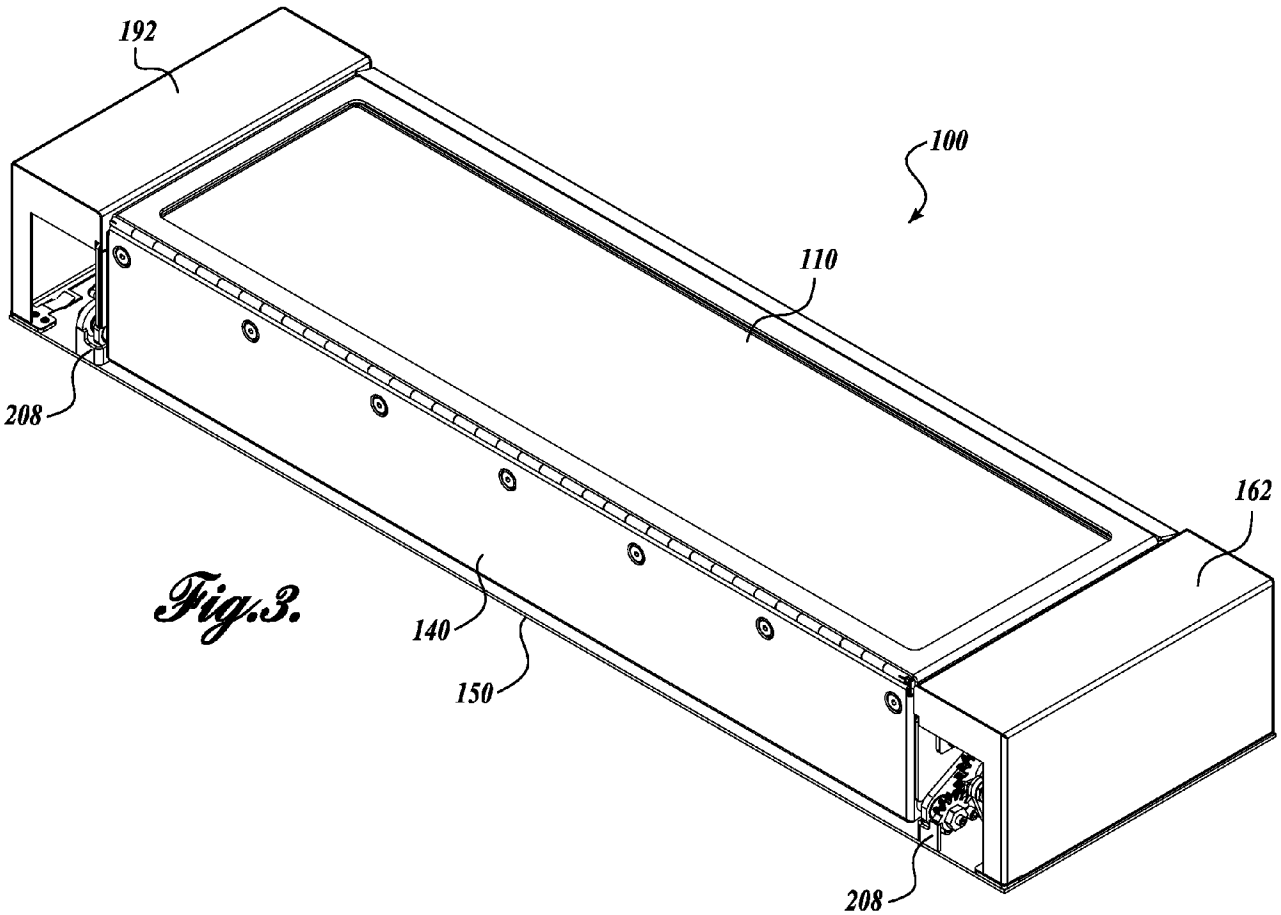
FIG. 3 is a rear isometric view the step assembly shown in FIG. 1, wherein the step assembly is in the raised position.
Figure 4:
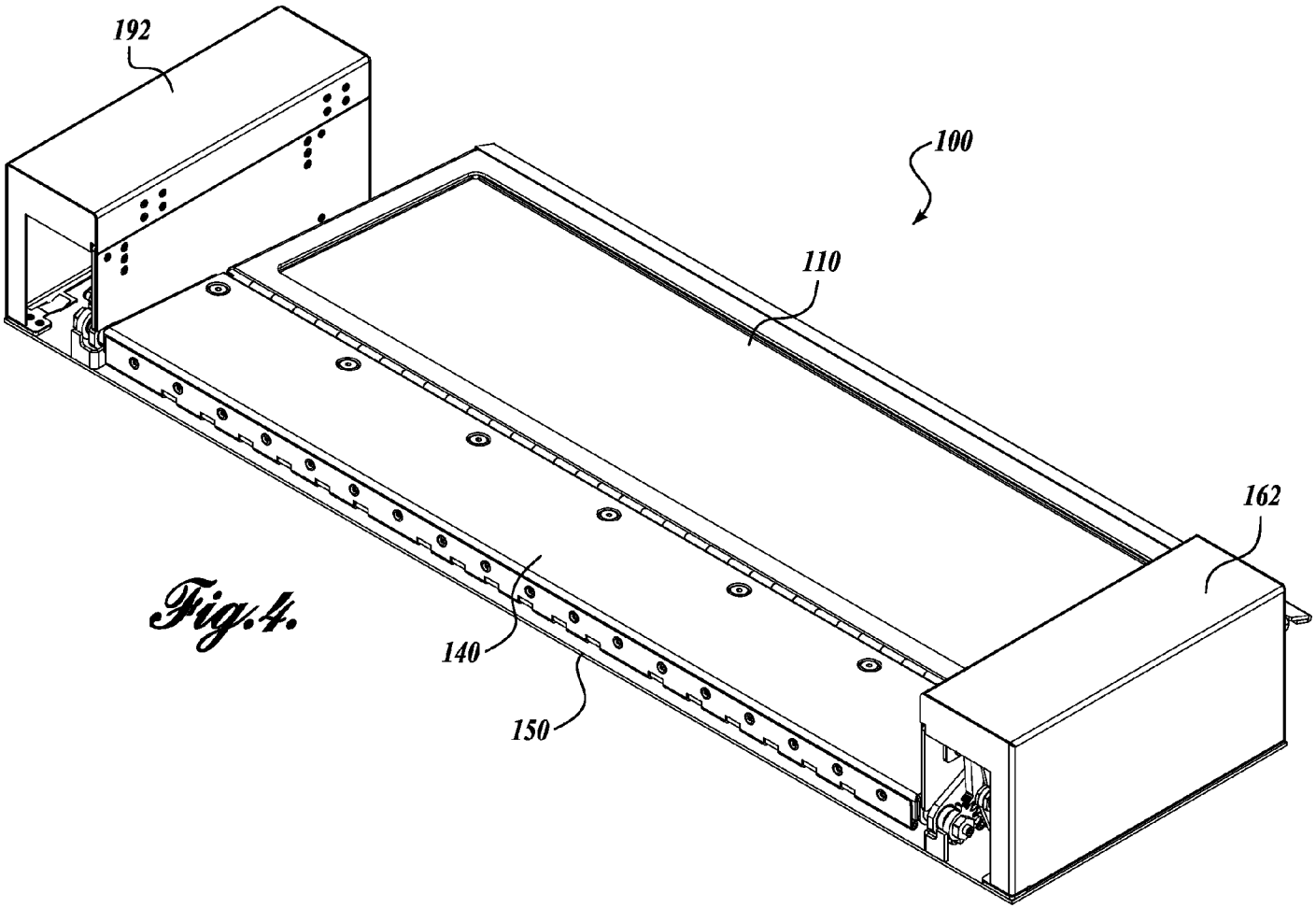
FIG. 4 is a rear isometric view of the step assembly shown in FIG. 1, wherein the step assembly is in the lowered position.
Figure 5:
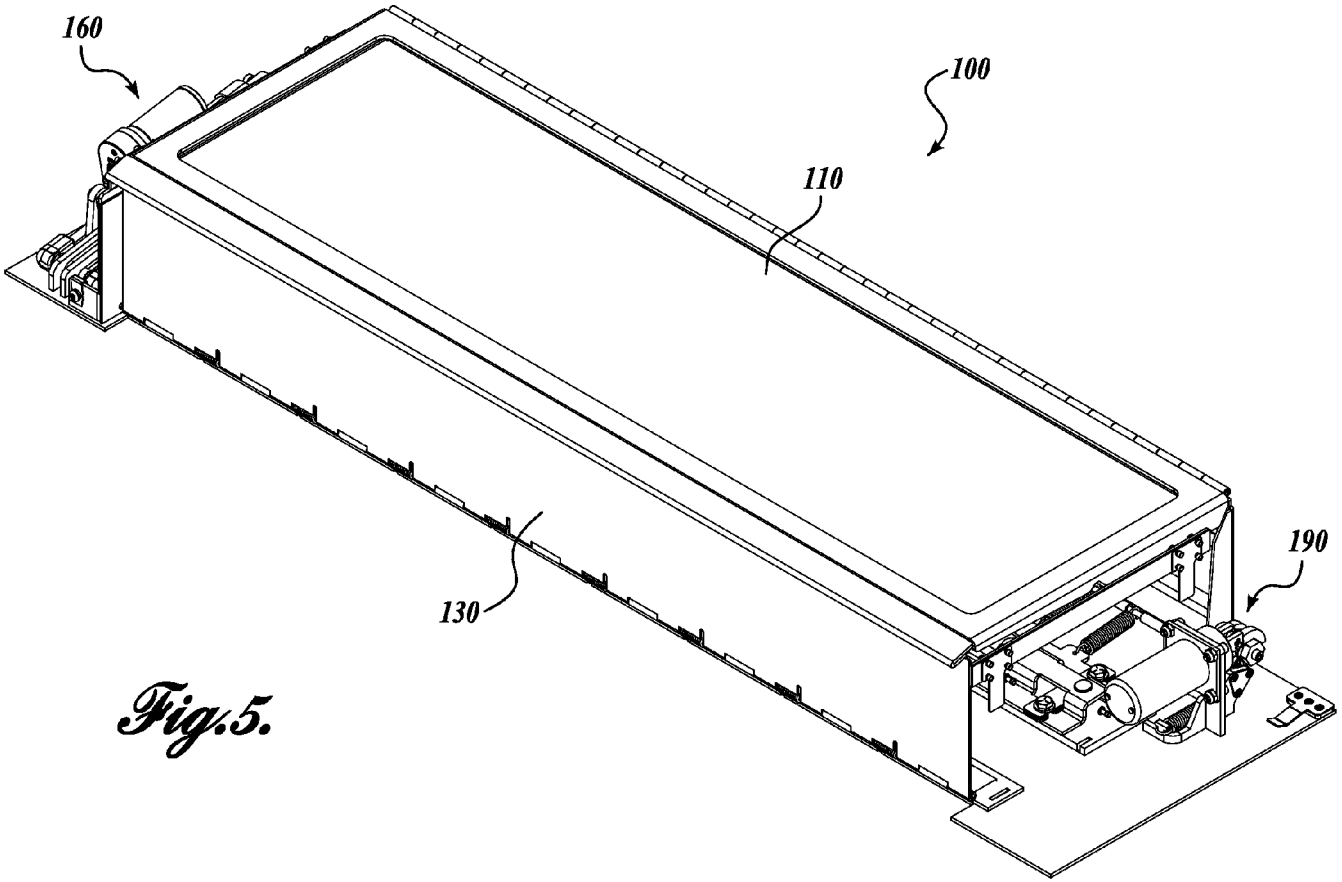
FIG. 5 is a front isometric view of the step assembly shown in FIG. 1 with a drive assembly cover and a latch assembly cover removed, wherein the step assembly is in the raised position.
Figure 6:
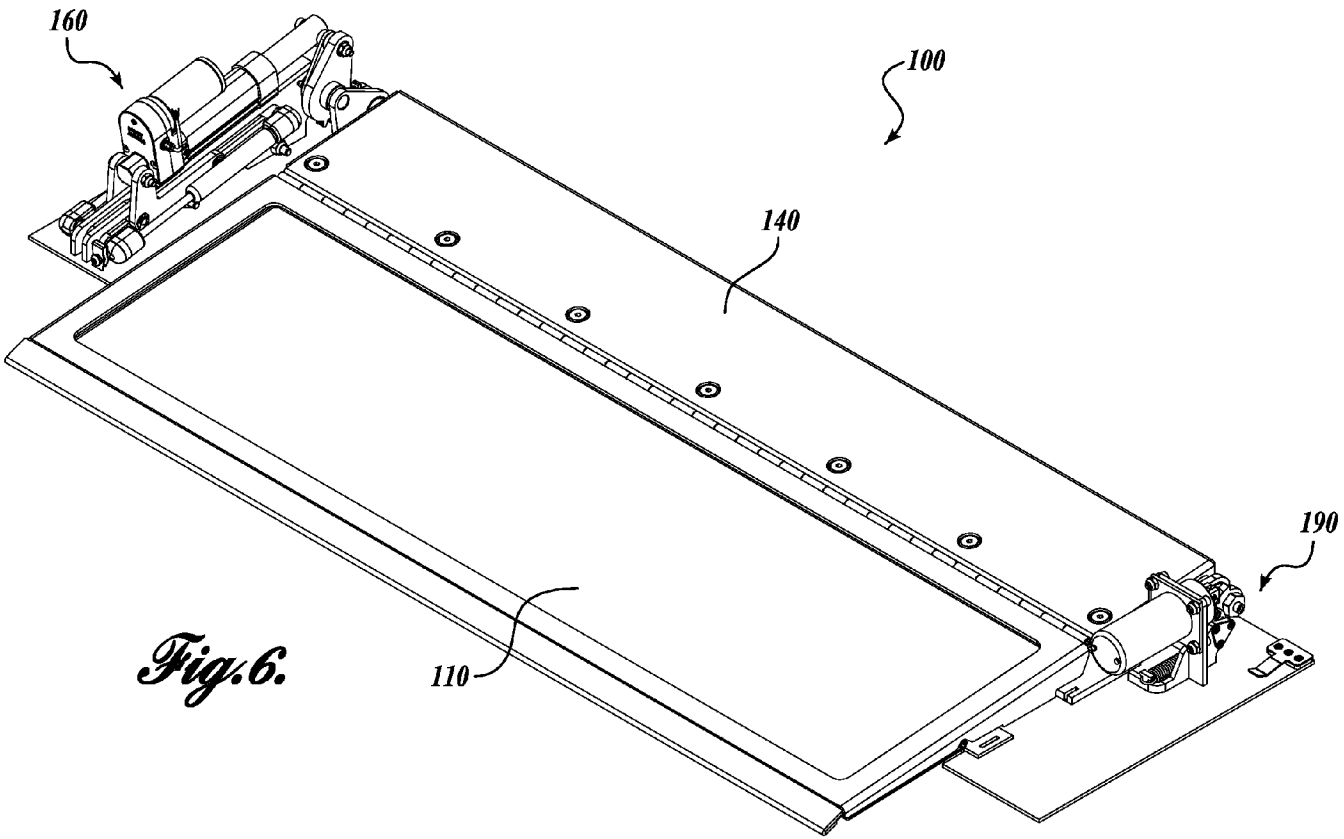
FIG. 6 is a front isometric view of the step assembly shown in FIG. 1 with the drive assembly cover and the latch assembly cover removed, wherein the step assembly is in the lowered position.
Figure 7:
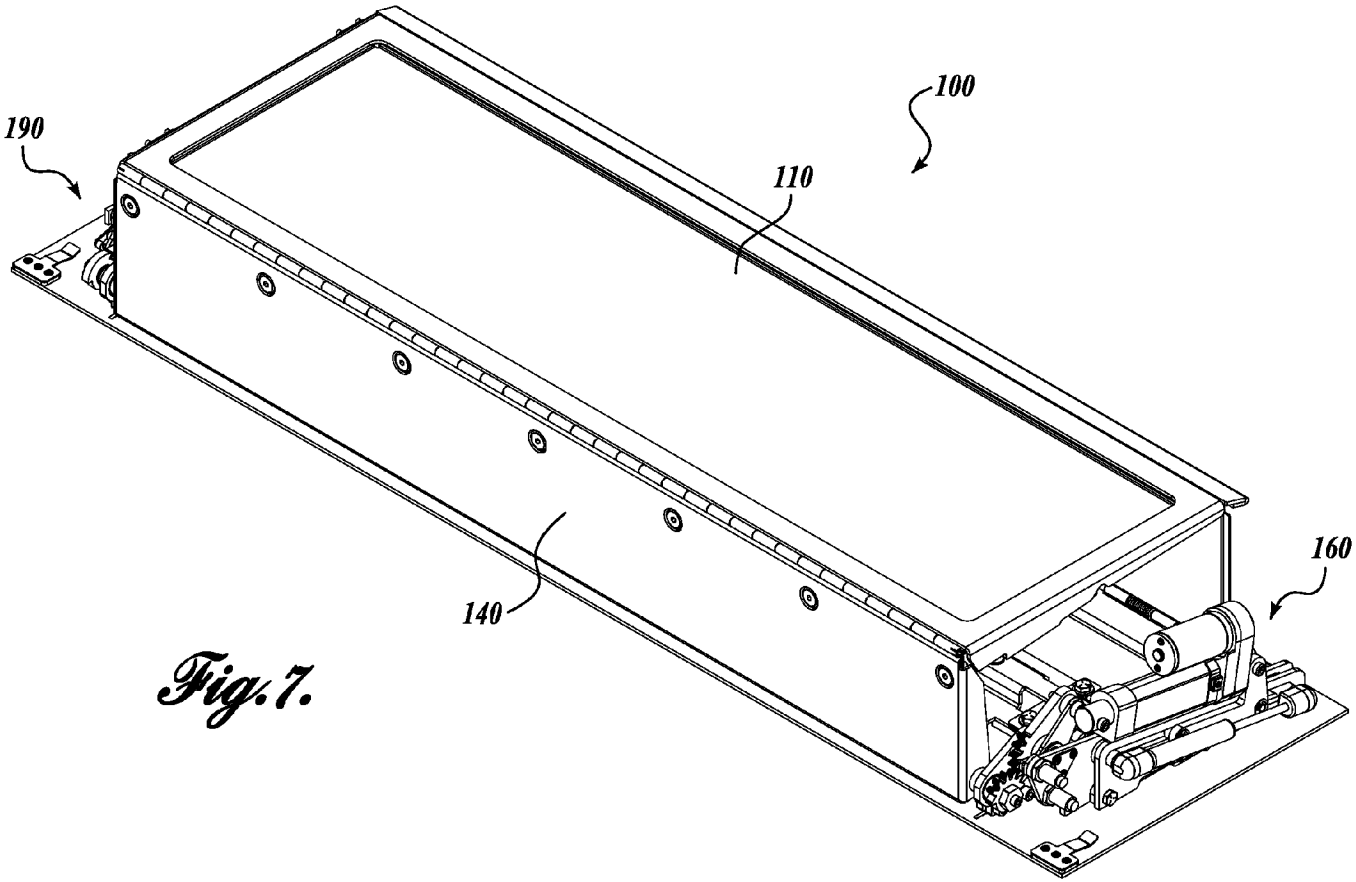
FIG. 7 is a rear isometric view of the step assembly shown in FIG. 1 with the drive assembly cover and the latch assembly cover removed, wherein the step assembly is in the raised position.
Figure 8:
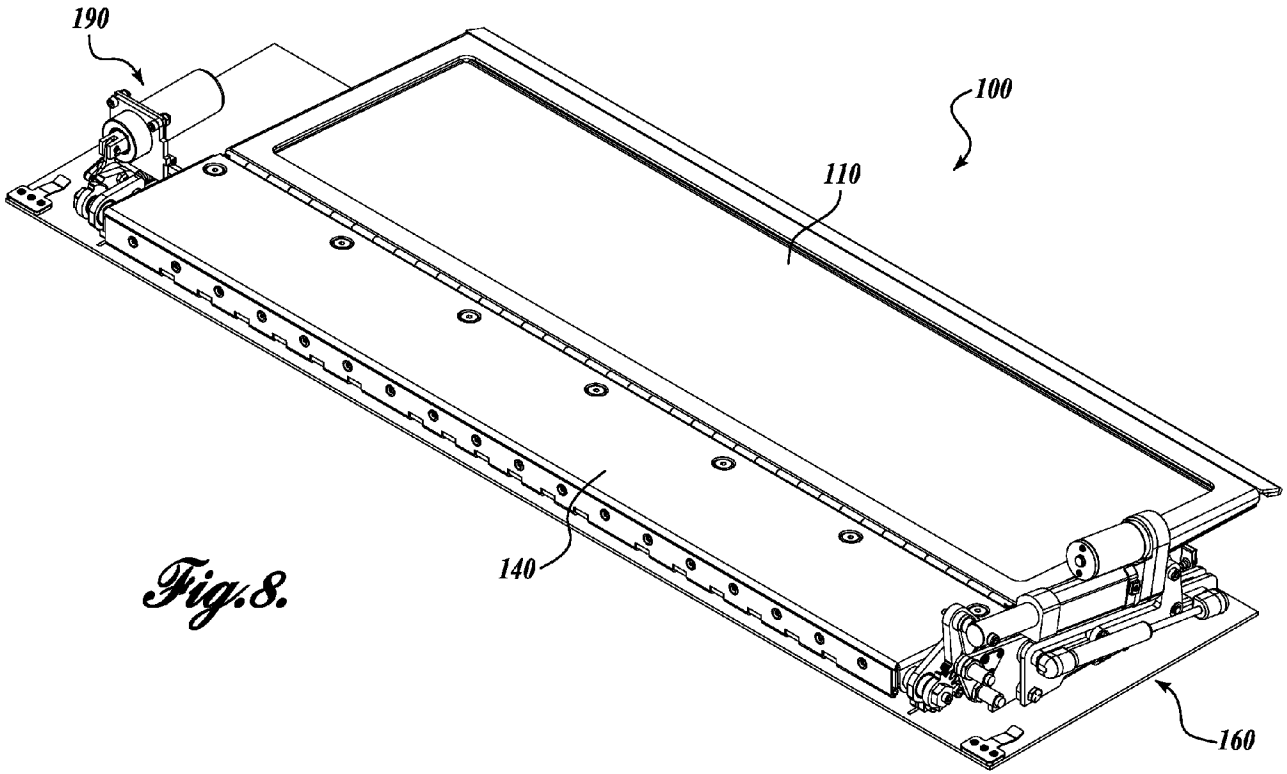
FIG. 8 is a rear isometric view of the step assembly shown in FIG. 1 with the drive assembly cover and the latch assembly cover removed, wherein the step assembly is in the lowered position.

FIGS. 1-4 illustrate an exemplary embodiment of an operable step assembly 100 (hereinafter "step assembly 100"). The step assembly 100 includes a tread 110, a riser 130, a support panel 140, and a base 150. A removable drive assembly cover 162 is positioned at one end of the step assembly 100 to cover a drive assembly 160 (shown in FIGS. 5-8), and a removable latch assembly cover 192 is disposed at the opposite end of the step assembly to cover a latch assembly 190 (shown in FIGS. 5-8). As will be described in detail, the step assembly 100 is selectively operable to reciprocate between a raised position (FIGS. 1 and 3) and a lowered position (FIGS. 2 and 4). It should be appreciated that the location of the drive assembly and latch assembly are exemplary only and should not be considered limiting. In this regard, location of these assemblies can be changed to accommodate various environments and space limitations. Such variations should be considered within the scope of the present disclosure.

The step assembly 100 facilitates a user's movement between an alighting surface and a moveable platform (or other suitable surface). During normal use, the platform is positioned at a first elevation, which is higher than that of the alighting surface. When the platform is so positioned, the step assembly 100 is in the raised position and provides a standard step configuration to facilitate ingress to and egress from the platform area by ambulatory users. To assist mobility-impaired users to move between the alighting surface and the platform, the platform is lowered from the first elevation to a second elevation. The step assembly 100 is also moved from its raised (step) position to its lowered position, in which the step assembly forms a ramp that provides a generally flat, inclined transition surface that extends from the alighting surface to the lowered platform area.

Figure 9:
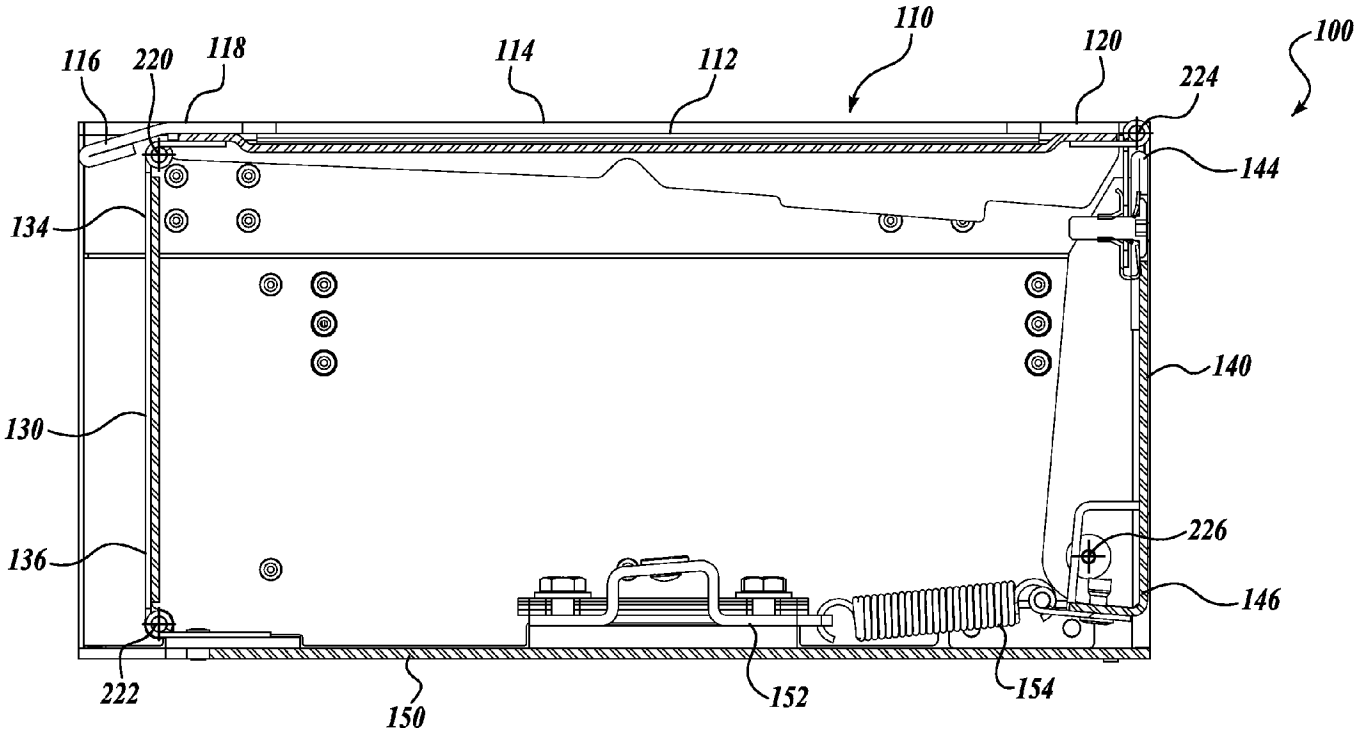
FIG. 9 is a cross-sectional view of the step assembly shown in FIG. 1, wherein the step assembly is in the raised position.
Figure 10:
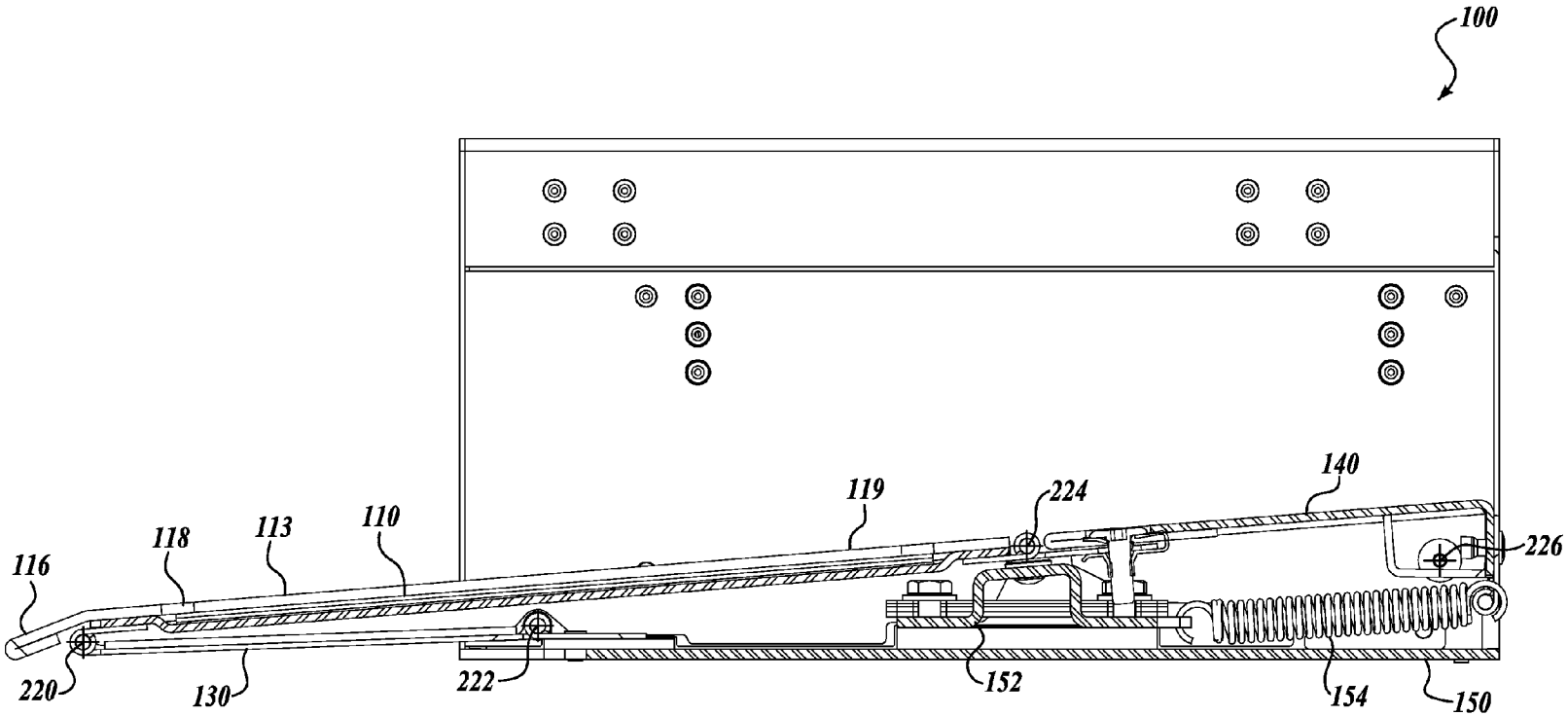
FIG. 10 is a cross-sectional view of the step assembly shown in FIG. 1, wherein the step assembly is in the lowered position.

Referring to FIGS. 1, 9, and 10, the tread 110 comprises a generally rectangular panel 112. The panel 112 is formed of known materials to have suitable strength and durability such that the tread 110 can withstand user traffic in both the raised (step) and lowered (ramp) positions. A texture is preferably formed integrally with or applied to the upper surface 114 of the panel 112 to provide increased traction on the upper surface of the tread. As best shown in FIG. 10, a tapered nose portion 116 is optionally formed in or coupled to the forward edge 118 of the tread 110 to provide a smooth transition between the upper surface of the tread and the alighting surface when the step assembly is in the lowered position.

Still referring to FIGS. 1, 9, and 10, the riser 130 comprises a generally rectangular panel having a length approximately equal to the length of the tread 110. The upper edge 134 of the riser 130 is rotatably coupled to the forward edge 118 of the tread 110 about an axis 220 with a hinge or other suitable structure. Similarly, the lower edge 136 of the riser 130 is rotatably coupled to the base 150 about an axis 222.

Like the riser 130, the support panel 140 comprises a rectangular panel having a length approximately equal to the length of the tread 110. The upper edge 144 of the support panel 140 is rotatably coupled to the rear edge 120 of the tread 110 about an axis 224 with a hinge or other suitable structure. The lower edge 146 of the support panel 140 is rotatably coupled in a similar manner to the base 150 about an axis 226.

Referring now to FIG. 9, when the step assembly 100 is in the raised position, the step assembly takes the form of a standard step. The upper surface of the tread 110 is in a substantially horizontal position, and the riser 130 extends downward from a front portion of the tread to provide a substantially vertical surface that extends from the tread to the base 150. In this position, the support panel 140 extends downward from a rear portion of the tread 110 to the base 150 and is generally parallel to the riser 130. In the illustrated embodiment, the riser 130 and the support panel 140 support the tread 110. Accordingly, the riser 130 and support panel 140 are sized and configured to withstand the loads associated with use of the step assembly 100. It is contemplated that different environments may expose the step assembly 100 to increased loads. Accordingly, additional supports and other structural enhancements may be included to increase the strength and durability of the step assembly 100 and its components.

To move the step assembly from the raised position (FIG. 9) to the lowered position (FIG. 10), the drive assembly 160, described later, rotates the support panel 140 forward about axis 226. As the support panel 140 rotates forward, the angle between the tread 110 and the support panel 140 increases until it reaches approximately 180 degrees when the step assembly is in the lowered position. At the same time, the angle between the tread 110 and the riser 130 decreases as the riser folds under the tread.

Figure 11:
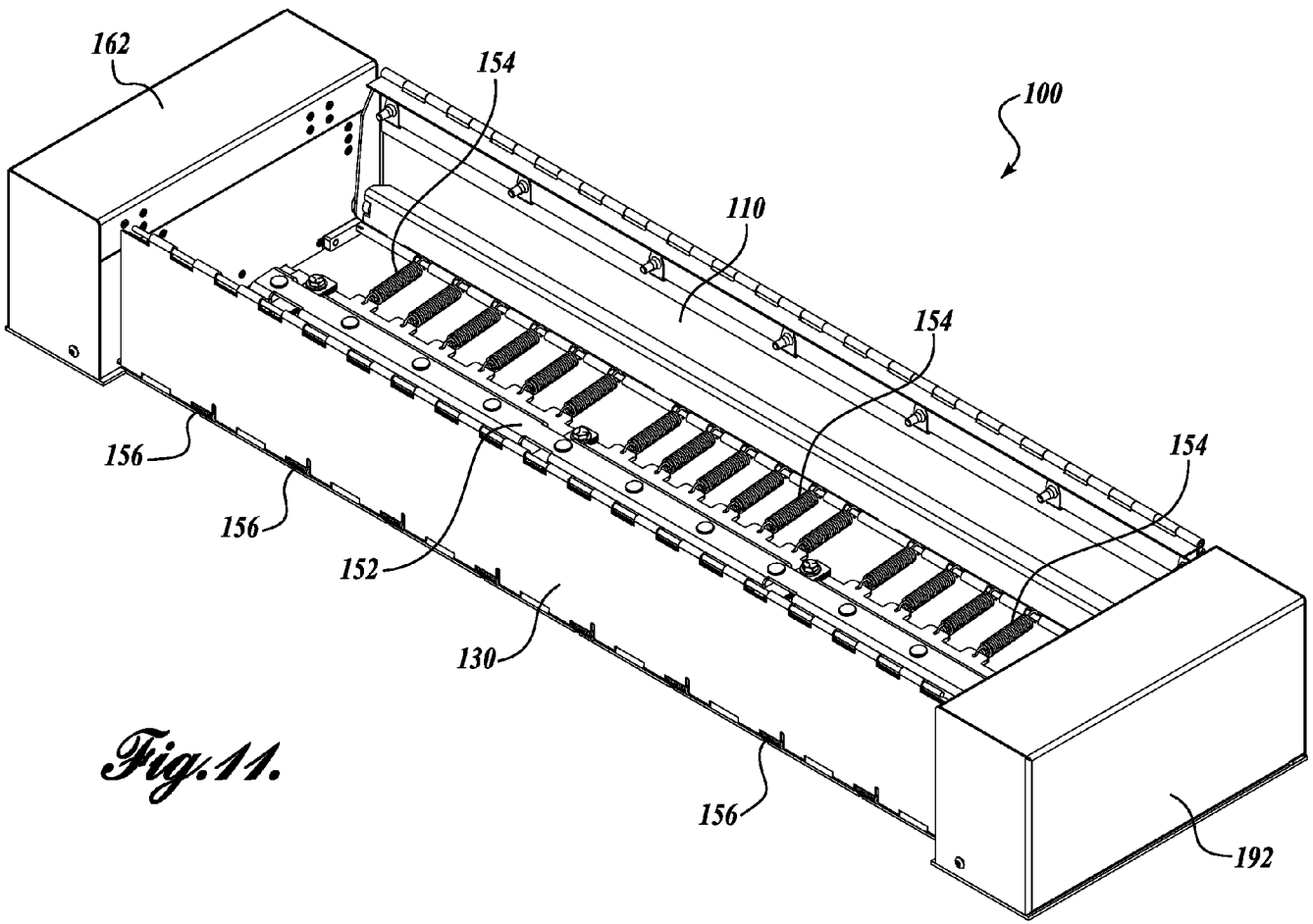
FIG. 11 is a front isometric view of the step assembly shown in FIG. 1 with the tread removed, wherein the step assembly is in the raised position.

Referring now to FIG. 10, when the step assembly 100 is in the lowered position, the tread 110 and the support panel 140 cooperate to form an inclined surface that provides a transition from the moveable platform to the alighting surface. As shown in FIGS. 9-11, a hinge support 152 is coupled to the base. When the step assembly 100 is in the lowered position, the hinge support 152 contacts the hinged connection between the tread 110 and the support panel 140, providing additional stability to the ramp. In the illustrated embodiment, the hinge support 152 is a hat-shaped extrusion or formed sheet metal part that extends the length of the tread 110. Alternate embodiments are contemplated in which the hinge support 152 includes multiple discreet hinge supports positioned along the base and at positions other than or in addition to those disposed directly under the hinge. These and other variations that provide additional support to one or both of the tread 110 and support panel 140 are contemplated and should be considered within the scope of the present disclosure.

Referring now to FIG. 11, a counterbalance configuration is included to counteract a tendency of the step assembly 100 to move toward the lowered position when the step assembly is between the raised position and the lowered position. As previously noted, when the step assembly 100 is in the raised position, the riser 130 and the support panel 140 are generally vertical. Accordingly, the weight of the tread 110 and of the riser 130 and support panel 140 themselves do not impart a significant moment on the tread or the riser. As the step assembly 100 begins to move toward the lowered position, the riser 130 and the support panel 140, are no longer essentially vertical, instead extending at least partially in a forward direction. As a result, the weight of the step components impart a moment on the riser and support panel that tends to rotate the step assembly toward the lowered position. As the step approaches the lowered position, the magnitude of the moment increases. When moving the step assembly from the lowered position to the raised position, the drive assembly 160 must provide enough force to overcome this moment. By counterbalancing the step assembly 100, the force required to actuate the step assembly is decreased. This, in turn, allows for a smaller drive assembly and decreases wear and tear on the step assembly components.

Still referring to FIG. 11, each of a plurality of tension springs 154 is coupled at one end to the hinge support 152 and at the other end to the support panel 140. The springs 154 provide a force that at least partially counteracts the moment imparted about axis 226 by the combined weights of the tread 110, the riser 130, and the support panel 140. In this respect, the springs bias the step assembly 100 toward the raised position. As the step assembly moves toward the lowered position, the springs 154 are extended, and the biasing force provided by the springs increases. As a result, when the step assembly moves toward the lowered position, the biasing force provided by the springs 154 is increased.

Additional springs 156 are positioned along the hinge that connects the riser 130 to the base 150. In the illustrated embodiment, the springs 156 are torsion springs, each having one leg that moves with the riser 130 and one leg that remains fixed relative to the base 150. As the riser 130 rotates from the raised position to the lowered position, the springs 156 are twisted. As the springs 156 are twisted, they bias the step assembly 100 toward the raised position. As the step assembly 100 moves farther from the raised position, the amount by which the springs are twisted is increased. As a result, the biasing force provided by the springs 156 is increased.

The illustrated counterbalance springs 154 and 156 are exemplary only and should not be considered limiting. In this regard, the number, type and location of the springs can be varied to incorporate known counterbalance configurations. Further, the springs can be coupled to different structures than those in the illustrated embodiment. In addition, the amount of preload in the springs can be varied so that the biasing force provided by the springs more effectively counteracts the moment. These and other configurations are contemplated and should be considered within the scope of the present disclosure.

Figure 12:
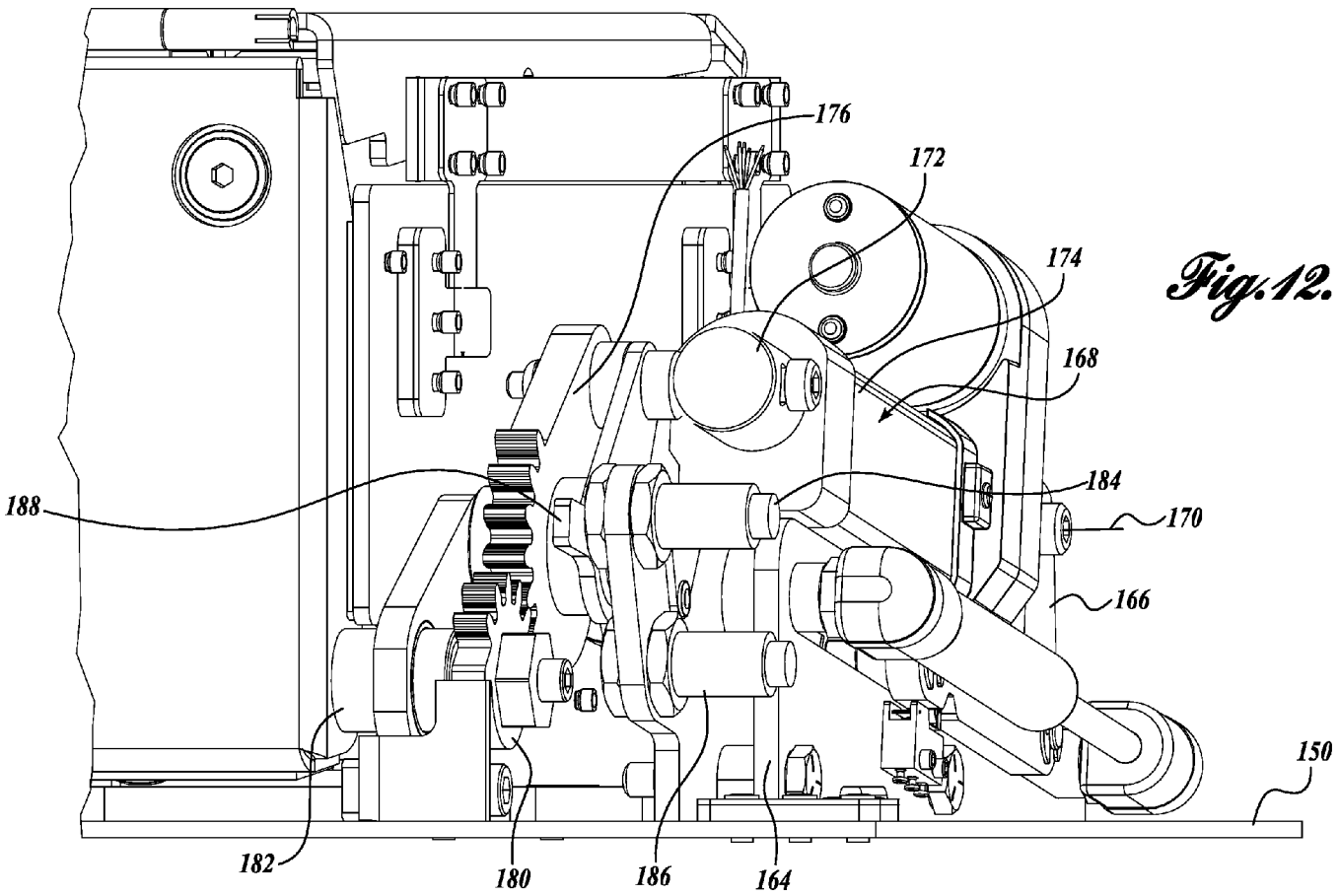
FIG. 12 is a rear isometric view of the drive assembly of the step assembly shown in FIG. 7, wherein the step assembly is in the raised position.
Figure 13:
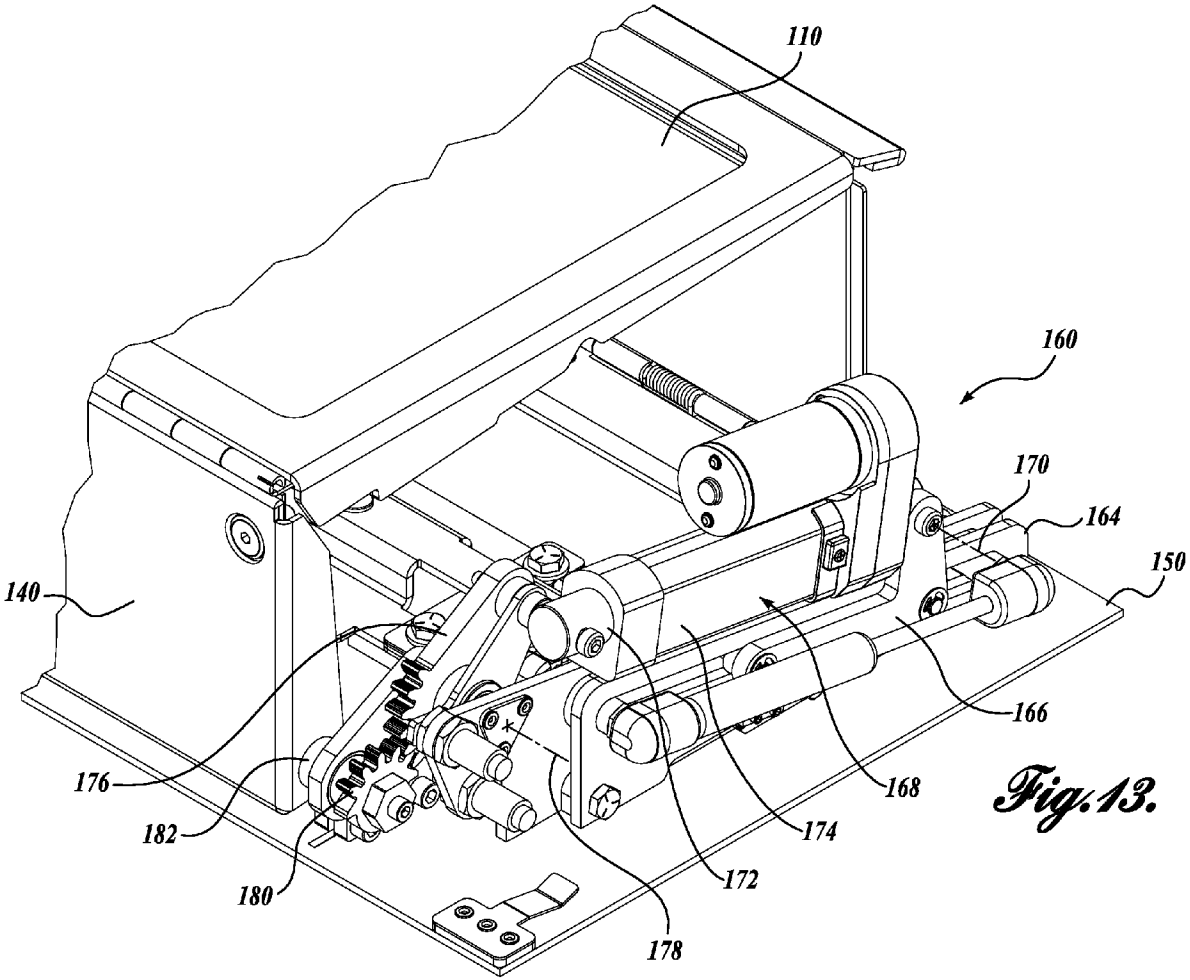
FIG. 13 is a rear isometric view of the drive assembly of the step assembly shown in FIG. 7, wherein the step assembly is in the raised position.
Figure 14:
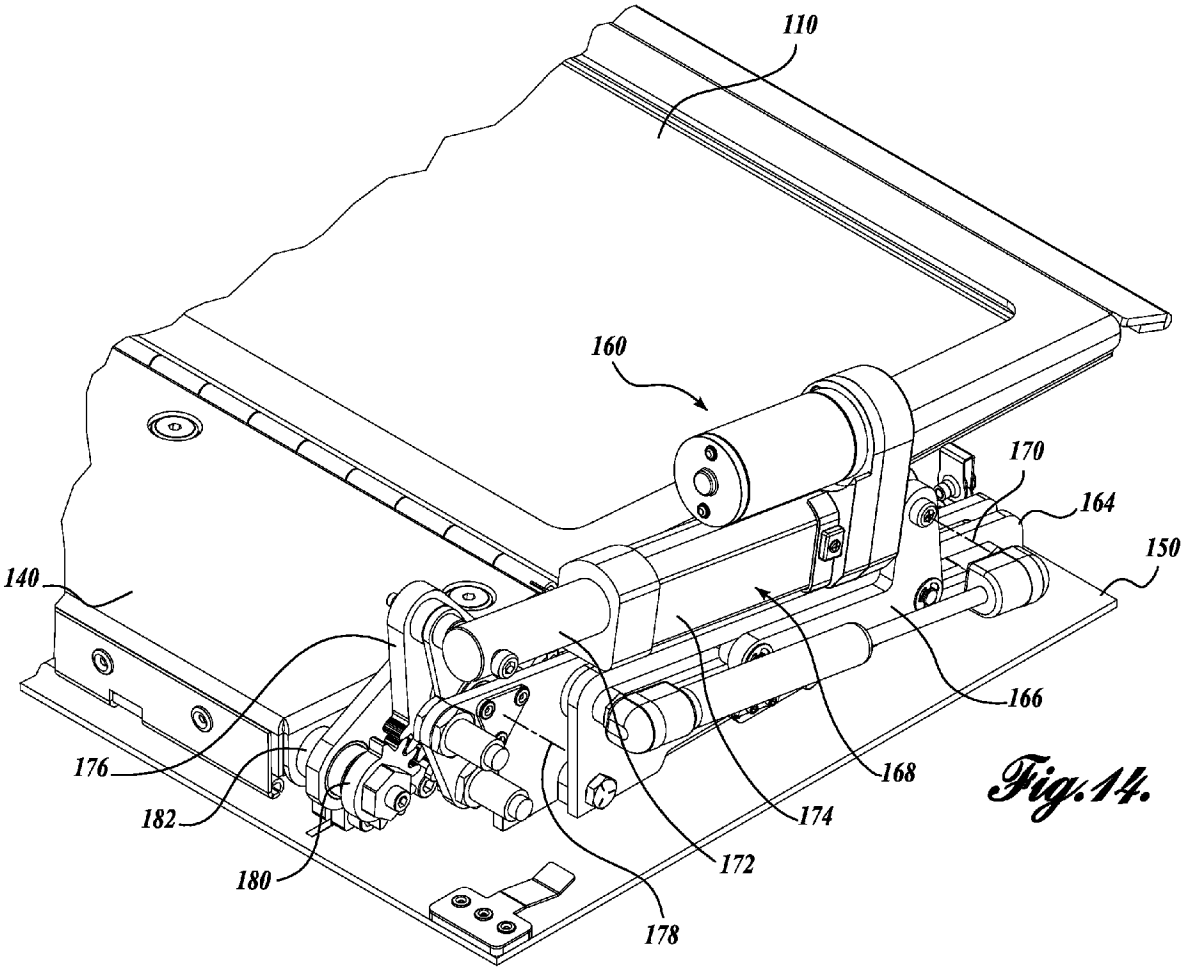
FIG. 14 is a rear isometric view of the drive assembly of the step assembly shown in FIG. 7, wherein the step assembly is in the lowered position.

The step assembly 100 includes a drive assembly 160 to selectively reciprocate the step assembly between the raised and lowered positions. Referring now to FIGS. 12-14, one exemplary embodiment of a drive assembly is illustrated.

As best shown in FIGS. 13 and 14, the drive assembly 160 includes a frame 164 fixedly secured to the base 150 and an actuator support 166 coupled to the frame. Under normal operating conditions, the actuator support 166 remains fixedly positioned relative to the frame 164. An actuator 168 is rotatably coupled to the actuator support 166 about an axis 170. In the illustrated embodiment, the actuator 168 is a known linear actuator having a rod 172, a portion of which is slidingly disposed within a housing 174. The actuator 166 is selectively controllable to extend or retract the rod 172.

A first gear 176 (a drive gear) is rotatably mounted to the frame 164 about an axis 178. The first gear is operably connected to the rod 172 of the actuator 168 such that extension and retraction of the rod rotates the gear 176 in first and second directions, respectively.

A second gear 180 is fixedly secured to a shaft 182, which is itself fixedly associated to the support panel 140. The central axis of the shaft 182 is coincident with the axis 226 about which the support panel 140 rotates when the step assembly 100 reciprocates between the raised and lowered positions. As a result, movement of the step assembly 100 between the raised and lowered positions rotates the gear 180 about axis 226.

The teeth of the first gear 176 are engaged with the teeth of the second gear 180. As the actuator rod 172 extends, the rod rotates the first and second gears to drive the support panel and, thus, the step assembly 100 toward the lowered position. Conversely, when the actuator rod 172 retracts, the rod rotates the first and second gears in the opposite directions to drive the step assembly 100 toward the raised position.

The drive assembly 160 includes position sensors 184 and 186 to sense when the step assembly 100 is in the raised and lowered positions. Still referring to FIGS. 12-14, upper position sensor 184 and lower position sensor 186 are mounted to a portion of the frame 164. A position sensor fitting 188 is rotatably coupled to the frame 164 about the same axis 178 as the drive gear 176 such that the position sensor fitting rotates with the drive gear. A tab extends from the position sensor fitting and is sensed by one of the position sensors when located proximate to that sensor. When the step assembly 100 is in the raised position, the tab is proximate to the upper position sensor 184, which senses the tab and sends a signal indicating that the step assembly is in the raised position. Similarly, when the step assembly 100 is in the lowered position, the tab is proximate to the lower position sensor 186, which senses the tab and sends a signal indicating that the step assembly is in the lowered position.

The illustrated position sensor configuration is exemplary only. The number, location, and type of sensors can vary, and such variations should be considered within the scope of the present disclosure. In one contemplated embodiment, a position sensor, such as an potentiometer or encoder is integral to the linear actuator. In such an embodiment, the extension of the actuator is indicative of the position of the step assembly 100. It will be appreciated that any type of position sensor can be utilized. Moreover, one or more position sensors can be configured to detect the position of any moveable portion or portions of the step assembly 100 that would indicate whether the step assembly is in the lowered position or the raised position.

The illustrated drive assembly 160 is exemplary and should not be considered limiting. In this regard other possible variations are contemplated. For example, the actuator need not be a linear actuator, but can instead be a rotary actuator. Moreover, the actuator can be powered by an electric motor, hydraulics, pneumatics, or any other suitable power source. In addition, the transmission mechanism that transfers the drive force from the actuator to the support panel is not limited to the disclosed gear combination. Any number of gears, linkages, chain/sprocket combinations, cables or other suitable transmission mechanisms can be utilized and should be considered within the scope of the present disclosure. Moreover, the actuating force need not be applied to the support panel, but instead be applied to the riser, the tread, or any other structural element that moves when the step assembly 100 reciprocates between the raised and lowered positions.

Figure 15:
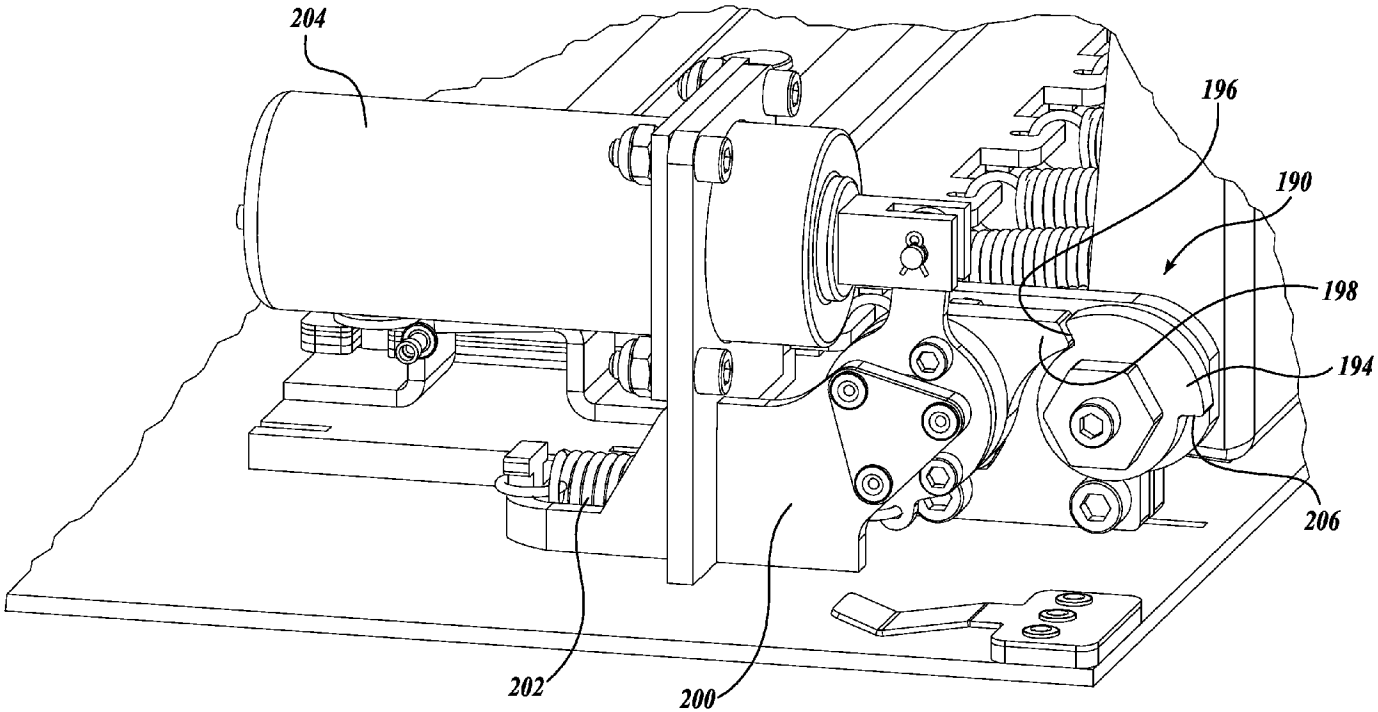
FIG. 15 is a rear isometric view of the latch assembly shown in FIG. 5, wherein the step assembly is in the raised position.
Figure 16:
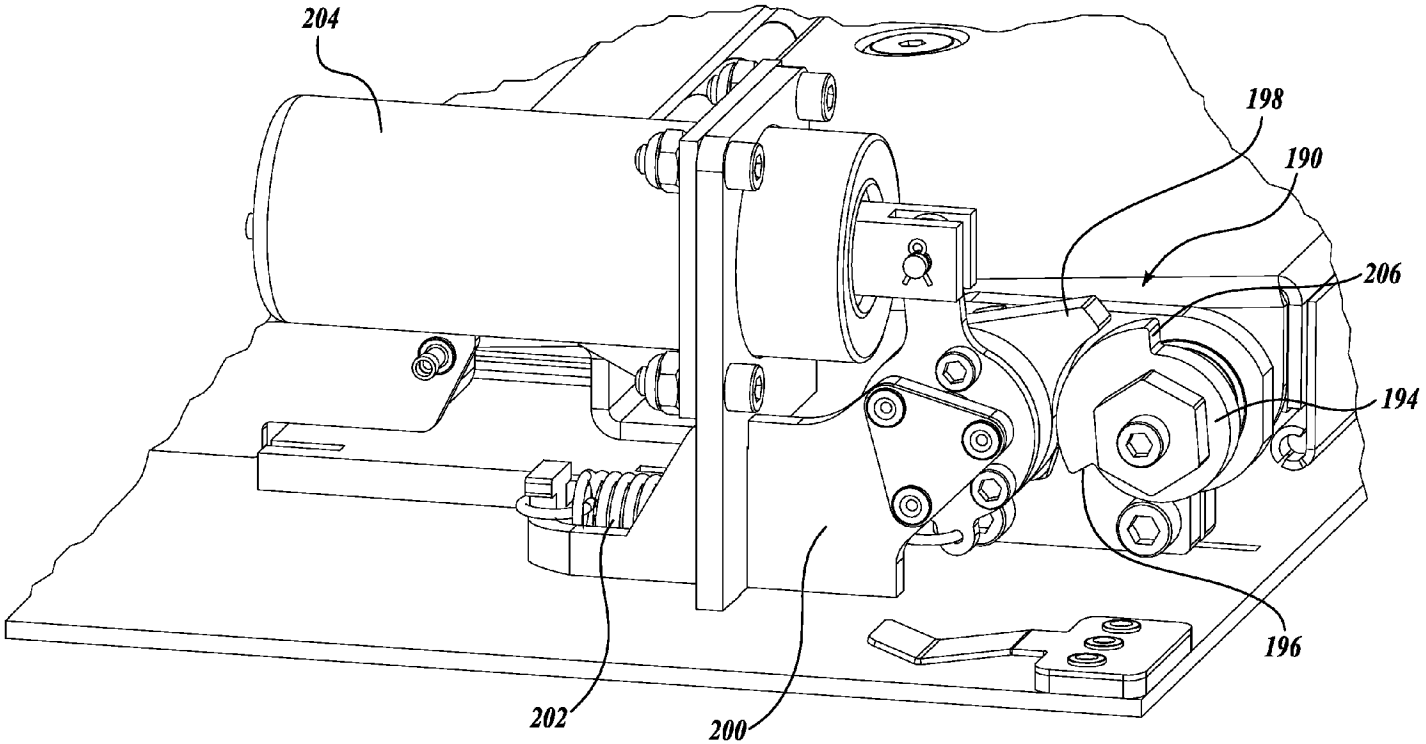
FIG. 16 is a rear isometric view of the latch assembly shown in FIG. 5, wherein the step assembly is in the lowered position.
Figure 17:
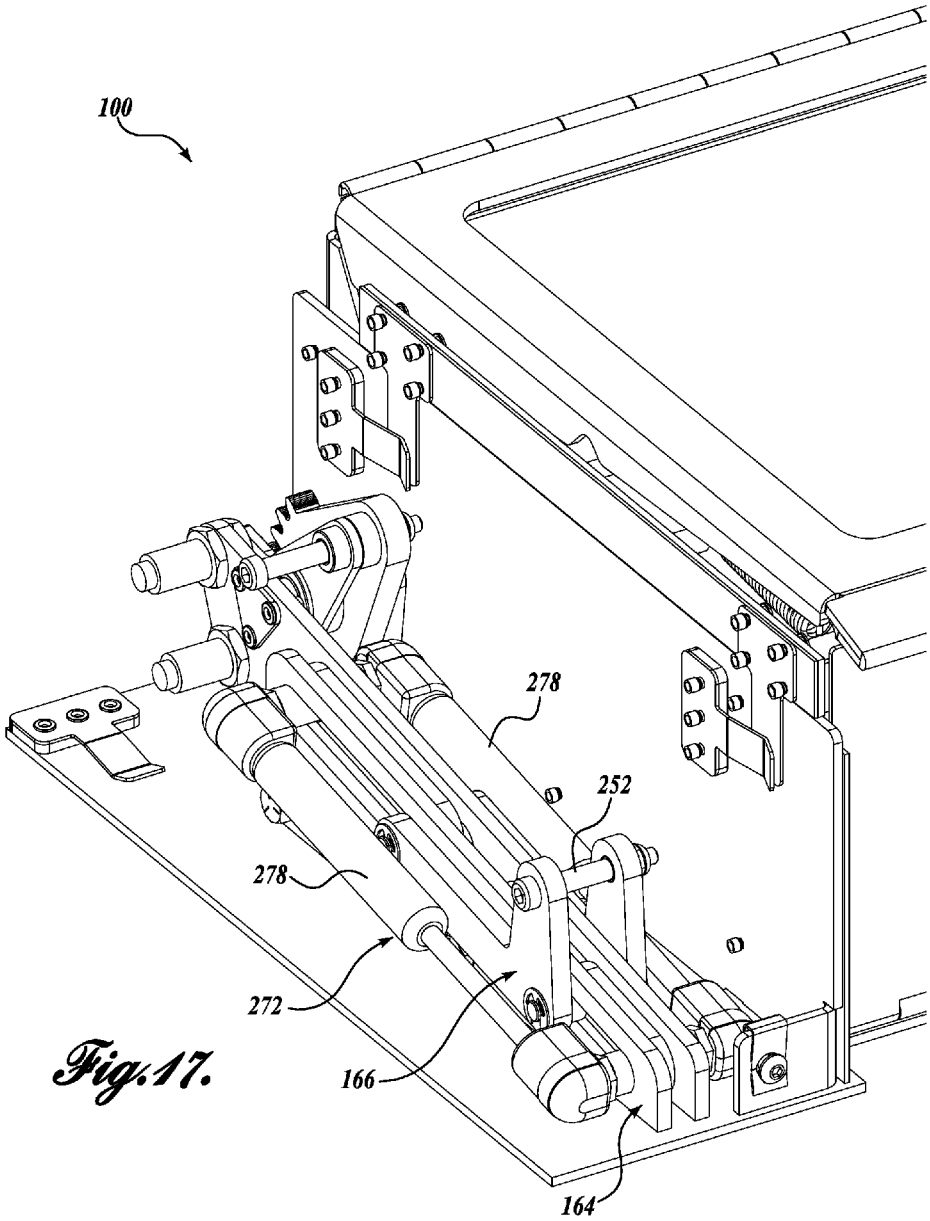
FIG. 17 is a front isometric view of the drive assembly shown in FIG. 7, wherein the actuator is removed, and the step assembly is in the raised position.

The step assembly 100 includes a latch mechanism 190 that, when engaged, locks the step assembly 100 in the raised position. When the latch mechanism 190 is disengaged, the step assembly 100 is free to reciprocate between the raised and lowered positions. Referring to FIGS. 15 and 16, one embodiment of the latch mechanism 190 includes a notched fitting 194 fixedly coupled to the support panel 140 so that the notched fitting rotates about axis 226 as the step assembly reciprocates between the raised and lowered positions. As a result, the notched fitting 194 rotates in a first direction when the step assembly moves from the raised position to the lowered position and in a second direction opposite the first direction when the step assembly 100 moves from the lowered position to the raised position.

The latch mechanism 190 further includes a pawl 198 rotatably mounted to a pawl support 200, which is fixedly secured to the base 150. A spring 202 is connected at one end to the pawl 200 support and at the other end to the pawl 198 so that spring biases the pawl to engage the notched fitting. An actuator 204 (illustrated as a solenoid) is operably coupled to the pawl 198 to selectively rotate the pawl away from the notched fitting 194, i.e., in a direction opposite to the direction in which the spring 202 biases the pawl.

As shown in FIG. 15, when the step assembly 100 is in the raised position, the pawl 198 is engaged with a notch 196 formed on the notched fitting 194 such that the pawl prevents the notched fitting from rotating in the first direction. This, in turn, prevents the step assembly from moving toward the lowered position.

The notched fitting 194 further includes a second notch 206 formed thereon. As best shown in FIG. 3, when the step assembly 100 is in the raised position, the second notch 206 engages a stop 208 formed in the latch assembly cover 192. Still referring to FIG. 3, a second stop 208 is formed in the drive assembly cover 162. When the step assembly 100 is in the raised position, the rear gear 180 of the drive assembly 160 (see FIG. 13) engages the second stop 208. The engagement of the second notch 206 and the rear gear 180 with the stops 208 prevent the step assembly 100 from rotating past the raised position. Thus, the latch assembly 190 stops the step assembly 100 from rotating in either direction when the step assembly is in the raised position.

To allow the step assembly to move from the raised position to the lowered position, the solenoid applies a biasing force to the pawl 198 to temporarily disengage the pawl from the notched fitting 194. With the pawl 198 disengaged, the step assembly is free to move toward the lowered position Once the notched fitting 194 has rotated out of the engaged position, the actuator 204 releases the pawl 198, and the spring 202 biases the pawl back to engage a side of the notched fitting. The pawl 198 remains in sliding contact with the side of the notched fitting 194 until the step assembly reaches the lowered position, shown in FIG. 16.

Still referring to FIGS. 15 and 16, when the step assembly 100 moves from the lowered position toward the raised position, the notched fitting 194 rotates toward the engaged position. The notched fitting 194 reaches the engaged position when the step assembly reaches the raised position. In this position, the spring biases the pawl 198 into engagement with the notch 196 in the notched fitting 194, thereby locking the latch mechanism 190 in the engaged position. As a result, the step assembly is locked in the raised position.

Referring now to FIGS. 17-24, the step assembly 100 includes an obstruction detection system. As the step assembly 100 reciprocates between the raised (step) position and the lowered (ramp) position, certain situations may arise in which the tread 110, riser 130, and/or support panel 140 contacts an obstruction that impedes the movement of the step assembly. In order to prevent injury or damage, the step assembly 100 detects when the movement of the step assembly is impeded and turns off the actuator 168 so that further movement of the step assembly is prevented.

As previously noted, the actuator support 166 maintains a generally fixed position relative to the base 150 under normal operating conditions. As shown in FIGS. 17-24, the actuator support 166 is slidably mounted to the frame 164 so that when the step assembly meets sufficient resistance to movement, the actuator support moves and triggers a switch to turn off the actuator.

Figure 18:
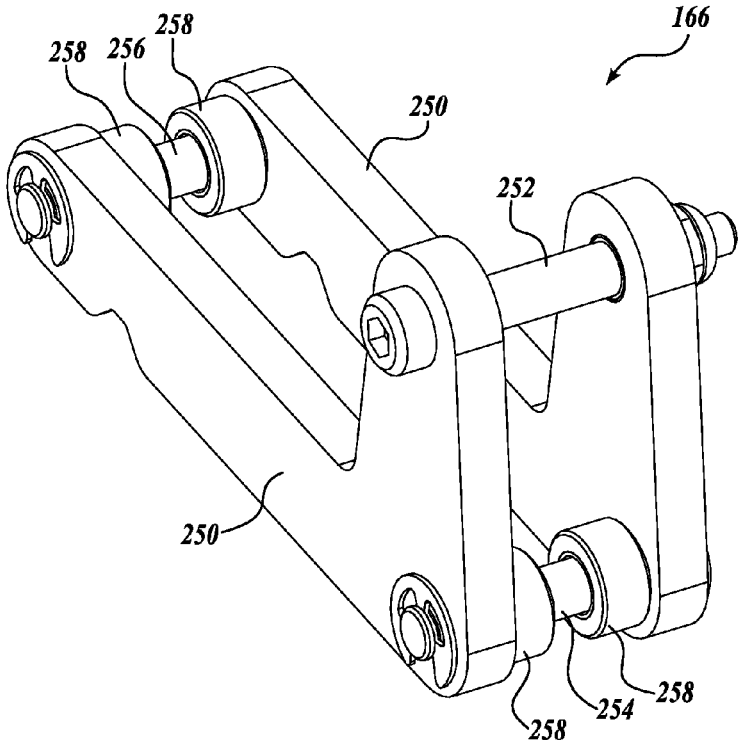
FIG. 18 is a front isometric view of an actuator support of the drive assembly shown in FIG. 17.

Referring to FIG. 18, an exemplary embodiment of the previously discussed actuator support 166 is shown. The actuator support includes a pair of L-shaped support fittings 250 spaced apart from each other. An actuator pin 252 connects the support fittings 250 at an upper portion of the actuator support 166. As shown in FIGS. 12-14, one end of the actuator 168 is rotatably coupled to the actuator pin 252 so that the actuator can rotate about the central axis 170 of the actuator pin.

Referring back to FIG. 18, the forward and rear ends of the actuator support are connected by a forward support pin 254 and a rear support pin 256, respectively. A pair of roller bearings 258 is disposed on each of the forward and rear support pins 254 and 256. The bearings 258 are positioned so that central portion of each support pin is exposed between the bearings.

Figure 19:
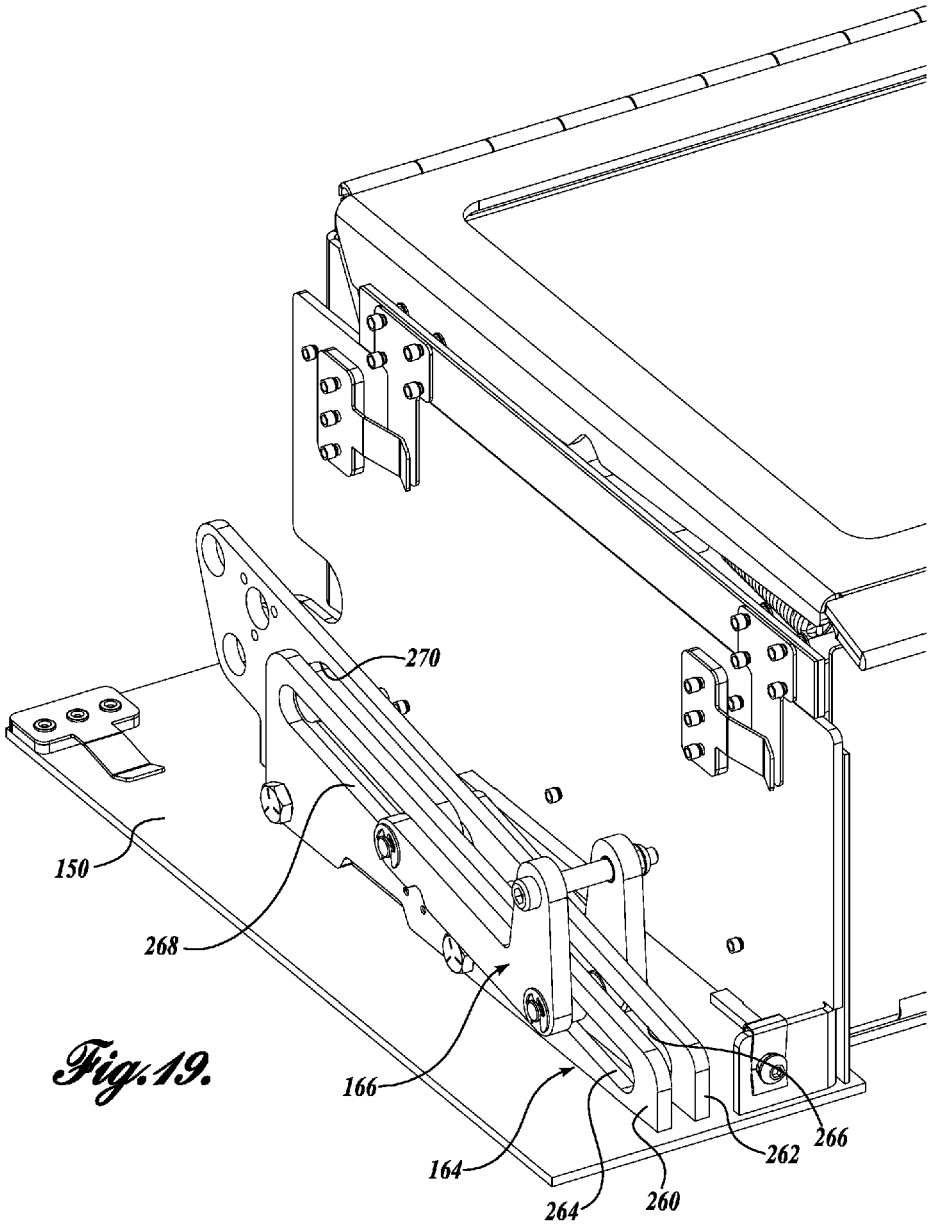
FIG. 19 is a front isometric view of the actuator support mounted to a frame shown in FIG. 17.

As best shown in FIG. 19, the actuator support 166 is slidably mounted to the previously discussed frame 164. The frame 164 includes two frame fittings 260 and 262 mounted to the base 150 and positioned parallel to each other. Each frame fitting 260 and 262 has a forward slot 264 and 266, respectively, and a rear slot 268 and 270, respectively, formed therein. The slots are sized and positioned such that the forward slots 264 and 266 are parallel to each other, and the rear slots 268 and 270 are parallel to each other.

When the actuator support 166 is mounted to the frame 164, frame fittings 260 and 262 are disposed between the support fittings 250. The forward support pin 254 extends through the forward slots 264 and 266, and the rear support pin 256 extends through the rear slots 268 and 270. Each of the four roller bearings 258 engages one of the slots so that the actuator support 166 can slide in generally forward and rearward directions in the slots.

Figure 20:
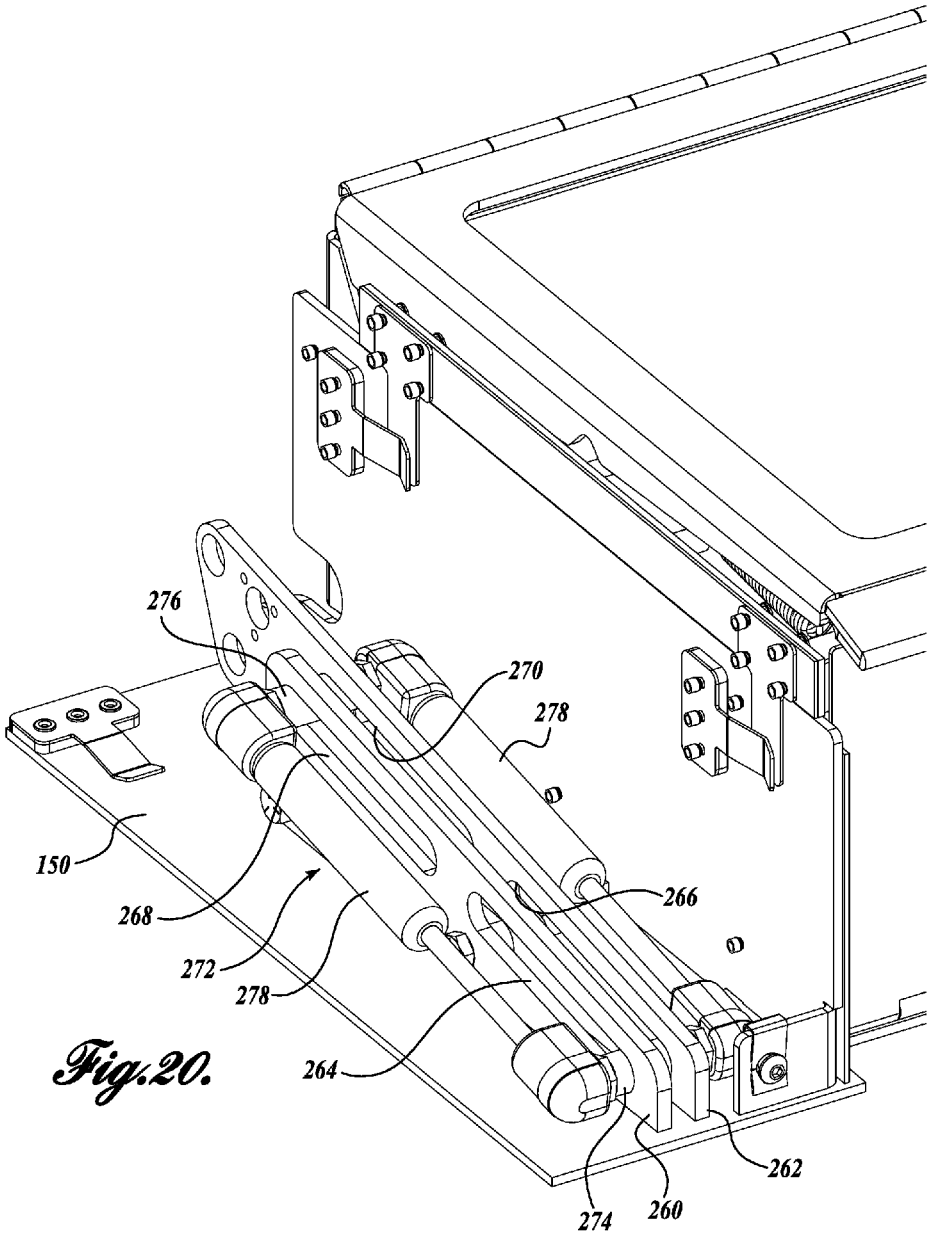
FIG. 20 is a front isometric view of a spring assembly mounted to the frame shown in FIG. 17.

Referring now to FIG. 20, a spring assembly 272 includes a forward spring pin 274 extending through the forward slots 264 and 266 of the frame 164. The spring assembly 272 further includes a rear spring pin 276 extending through the rear slots 268 and 270 of the frame 164. The spring pins 274 and 276 are connected on each side of the frame 164 by a compression spring 278. The forward and rear spring pins 274 and 276 are slidably disposed within their respective slots. Under normal operating conditions, i.e., when no obstructions are present, the forward spring pin is positioned at the forward ends of the forward slots 264 and 266, and the rear spring pin 276 is positioned at the rear ends of the rear slots 268 and 270. As a result, movement of the forward spring pin 274 in a rearward direction and movement of the rear spring pin 276 in a forward direction each further compresses the springs 278, which resist such movement by the spring pins.

In the illustrated embodiment, the compression springs are illustrated as gas springs. It should be appreciated that the type and number of springs are not limited to the disclosed pair of gas springs, but can instead include coil springs, hydraulic springs, pneumatic springs, or any other known type of spring that produces a resistive force in response to being compressed. Moreover, alternate embodiments utilizing tension springs, torsion springs or other biasing elements are contemplated. In addition, the springs 278 can be preloaded to set the desired force required to move the spring pins 274 and 276, i.e., to compress the springs.

Figure 21:
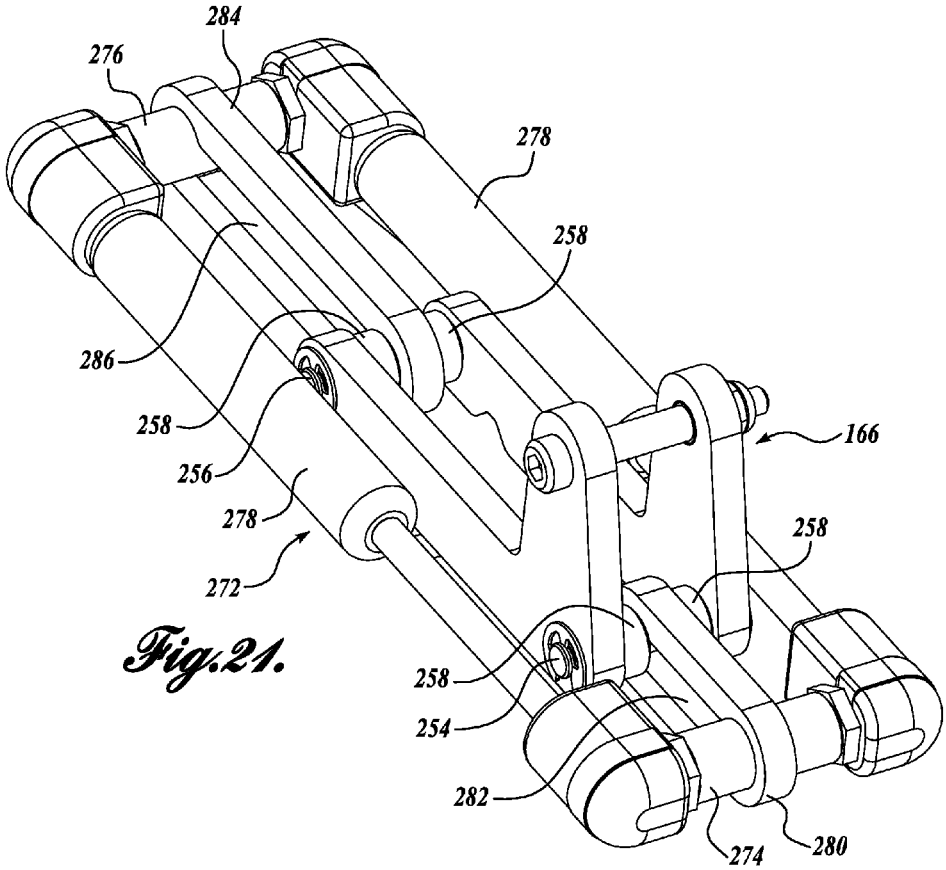
FIG. 21 is a front isometric view of the actuator support shown in FIG. 18 coupled to the spring assembly shown in FIG. 20.

Referring now to FIG. 21, the actuator support 166 is connected to the spring assembly 272 by a pair of slotted links. More specifically, the forward support pin 254 is coupled to the forward spring pin 274 by a forward link 280. The forward link 280 has a slot 282 formed therein. The forward support pin 254 extends through the slot 282, which is sized to allow the support pin to slide along the length of the slot. The forward spring pin 274 extends through a recess portion formed at the forward end of the slot 282. The diameter of the forward spring pin 274 is such that it can only extend through the slot 282 in the recess portion of the slot, i.e., it can not slide into the rear portion of the slot. Thus, the forward spring pin 274 is retained at the forward end of the slot 282.

A rear link 284 couples the rear support pin 256 to the rear spring pin 276. Similar to the forward link 280, the rear link 284 includes a slot 286 through which the rear support pin 256 extends and along which the rear support pin can slide. The rear spring pin 276 extends through a recess portion formed at the rear end of the slot 286, which is sized so that the rear spring pin is retained in the rear end of the slot.

Figure 22:
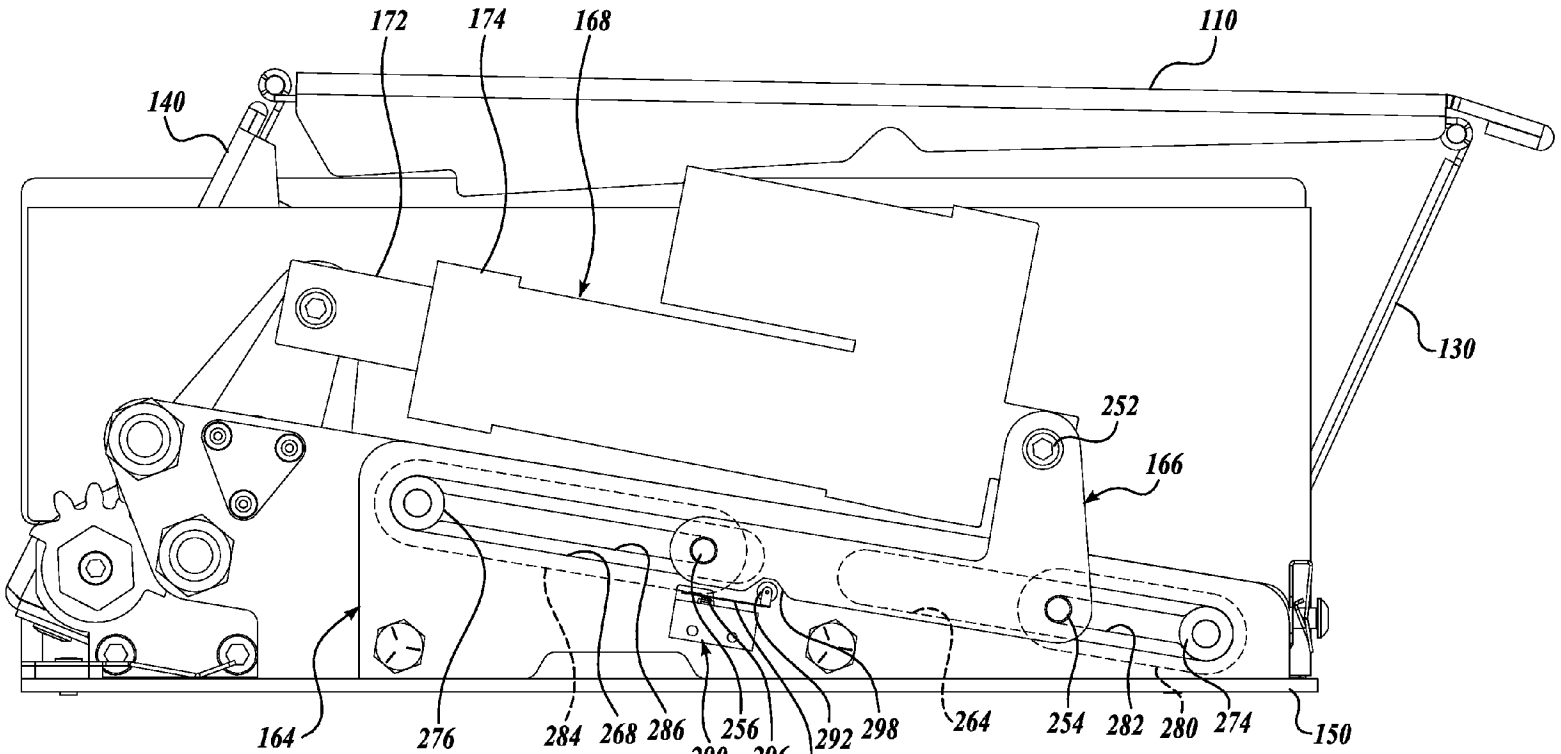
FIG. 22 is side view of the drive assembly shown in FIG. 13 wherein the step assembly is located between the raised position and the lowered position.

As shown in FIG. 22, a switch 290 is fixedly positioned relative to the frame 164. The switch includes a flexible arm 294 with a roller bearing 292 attached at one end. The switch 290 also includes a contact 296 located proximate to the flexible arm 294. When the flexible arm 294 is in an undeflected state, the arm does not touch the contact. Under normal step assembly operating conditions, the bearing 292 is at least partially disposed within a notch 298 formed in the actuator support 166. If the actuator support 166 moves in either a forward or rearward direction, the bottom of the actuator support contacts the bearing 292 and deflects the flexible arm 294 so that it touches the contact 296. When the flexible arm 294 touches the contact 296, the switch sends a signal to a controller (not shown) that an obstruction has been detected.

In response to the signal from the switch, the controller turns off the actuator 168 to prevent further movement of the step assembly 100 toward the obstruction. In another contemplated embodiment, the controller reverses the motion of the actuator 168 to move the step assembly 100 away from the detected obstruction. For such embodiments, the controller can move the step assembly 100 partially away from the obstruction or can return the step assembly 100 all the way to its previous position. In addition to stopping or reversing the actuator 168, the controller can activate a visual or audial alarm to indicate the presence of an obstruction. These and other suitable responses to an obstruction by the controller are contemplated and should be considered within the scope of the present disclosure, Still referring to FIG. 22, when the actuator support 166 and the spring assembly 272 are connected by the links 280 and 284 and are mounted to the frame 164, the actuator support is held in a generally fixed location. In this regard, the springs 278 (not shown) maintain the forward and rear spring pins 274 and 276 at a fixed distance from each other until a sufficient force is applied to the actuator support to compress the springs. As illustrated, the springs 278 maintain the forward spring pin 274 at the forward end of the forward frame slots 264 and 266 and also maintain the rear spring pin 276 at the rear end of the rear frame slots 268 and 270.

Figure 23:
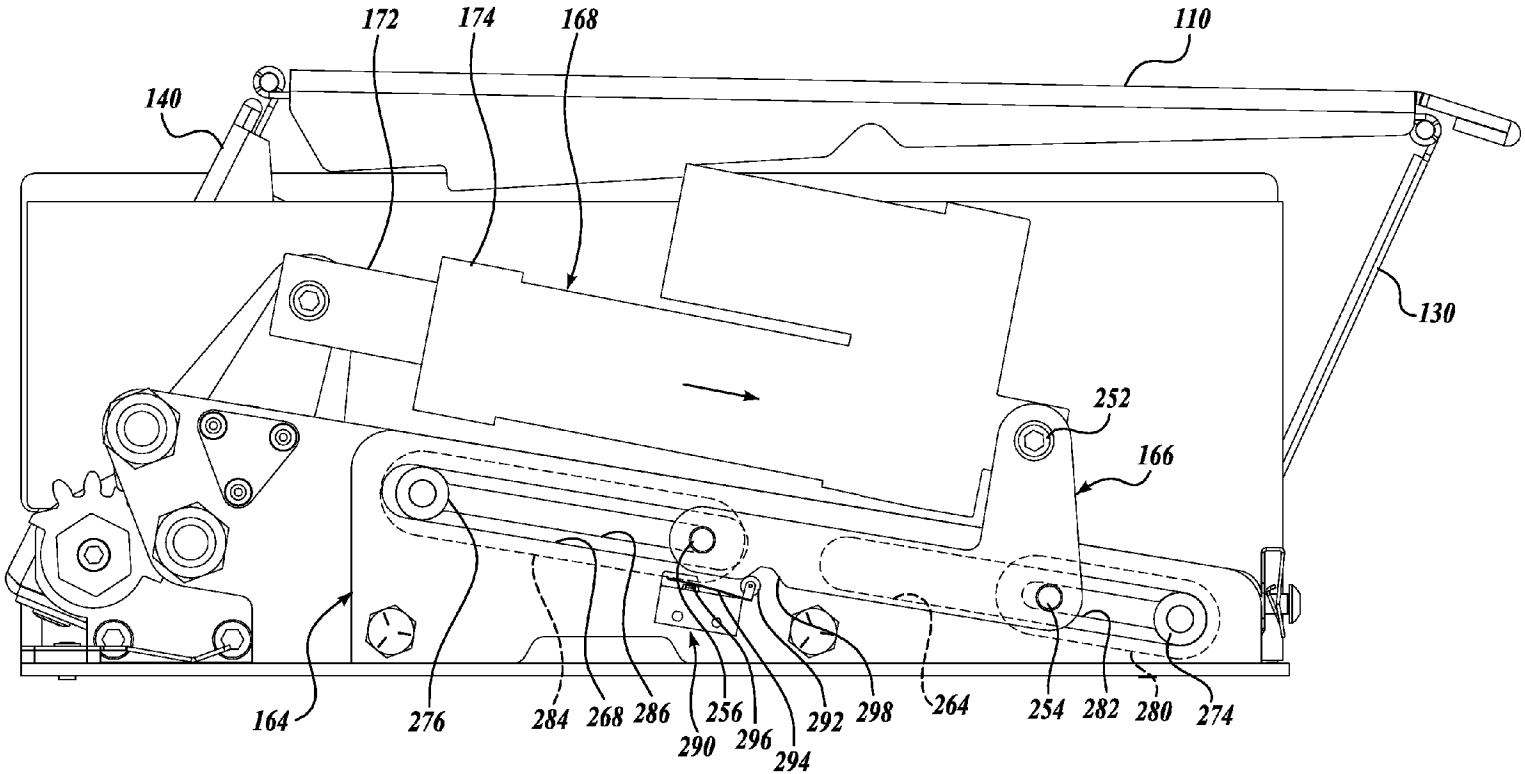
FIG. 23 is side view of the drive assembly shown in FIG. 22 during an overload condition occurring while the step assembly moves from the raised position to the lowered position.

Referring now to FIG. 23, an overload condition during movement of the step assembly from the raised position to the lowered position is described. As previously described, the actuator rod 172 extends from the actuator housing 174 to drive the step assembly 100 toward the lowered position. Under normal operating conditions, the force provided by the spring assembly 272 is sufficient to maintain the actuator support 166, and thus the actuator housing 174, in a fixed position so extension of the rod 172 from the housing rotates the drive gear 176 to move the step assembly.

In situations in which an obstruction impedes movement of the step assembly 100, the rod 172 is held in a fixed position and extension of the rod tends to drive the actuator support 166 in a forward direction. If the force biasing the actuator support 166 increases beyond a predetermined level, then the biasing force overcomes the resistive force applied by the springs 278, and the actuator support begins to move in a forward direction.

Still referring to FIG. 23, an obstruction impeding movement of the step assembly 100 toward the lowered position will tend to drive the actuator housing 174 and the actuator support 166 in a forward direction. As the actuator support 166 moves forward, the forward spring pin 274 remains engaged with the forward edges of the forward frame fitting slots 264 and 266. As a result, the forward link 280 remains in an essentially fixed position. With the position of the forward link 280 essentially fixed, the movement of the actuator support 166 drives the forward support pin 254 along the forward frame fitting slots 264 and 266 toward the forward spring pin 274.

Still referring to FIG. 23, movement of the actuator support 166, and therefore the rear support pin 256, in a forward direction pulls on the rear link 284, which in turn moves the rear spring pin 276 forward through the rear frame fitting slots 268 and 270. As the rear spring pin 276 moves forward, the springs 278 are compressed.

As the actuator support 166 moves in a forward direction, the notch 298 in which the switch roller 292 is normally disposed moves relative to the roller. As a result, the bottom of the actuator support 166 engages the roller 292 to deflect the arm 294 of the switch 290 downward until it touches the contact 296. When the arm 294 touches the contact 296, the switch 290 sends a signal to the controller that an obstruction has been detected. In response, the controller turns off or reverses the travel of the actuator 168.

Removal of the obstruction allows the step assembly to move to the correct position for the given position of the actuator rod 172 relative to the actuator housing 174. More specifically, the force from the compressed springs 278 moves the actuator support 166 back to its normal operating position, which returns the step assembly to its proper position. Returning the actuator support 166 to its normal operating position disengages the switch 290. For one embodiment in which the actuator is disabled in response to a detected obstruction, an operator is required to manually enable the actuator 168 after the switch 290 is disengaged. In other possible embodiments, the actuator 168 is automatically enabled when the switch is disengaged.

Figure 24:
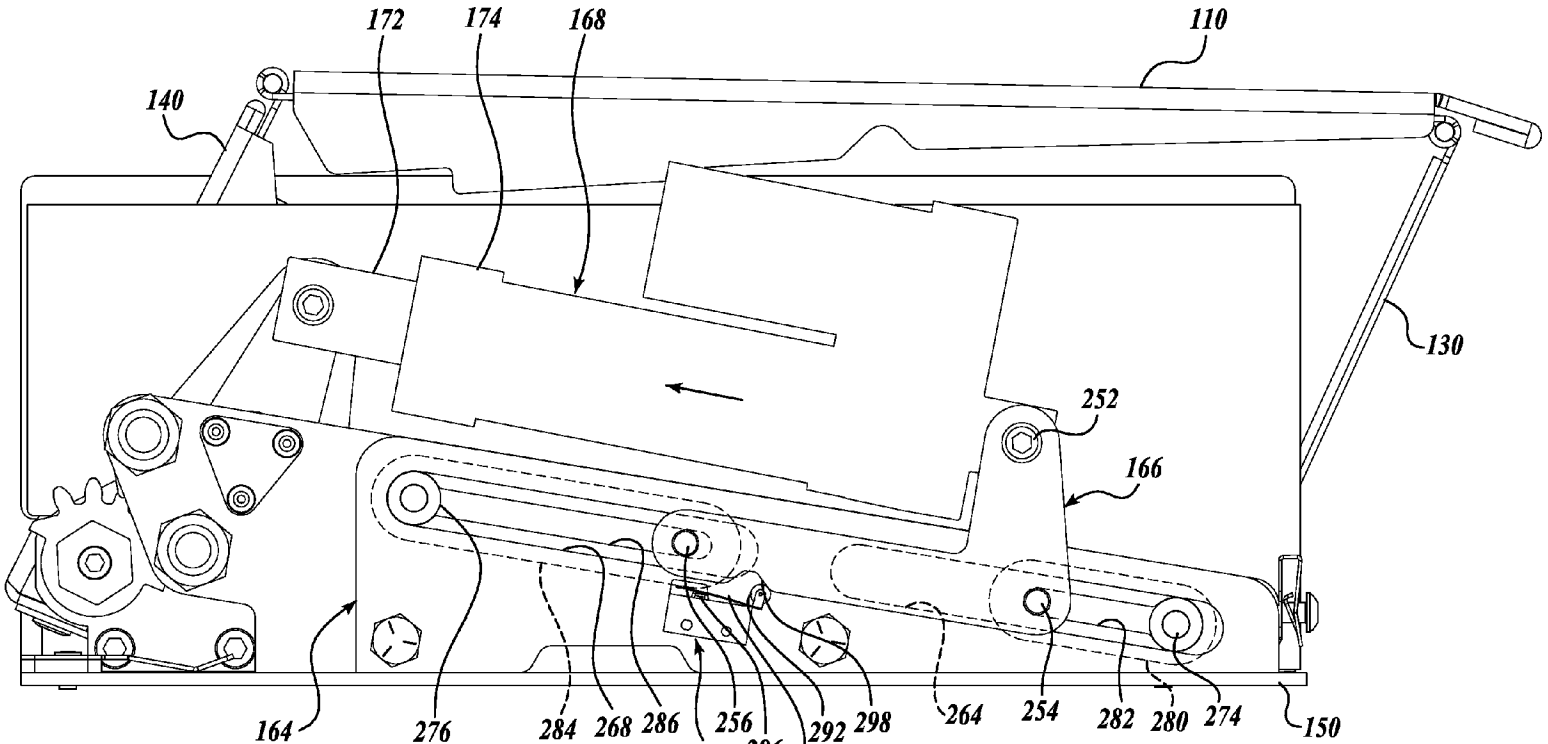
FIG. 24 is side view of the drive assembly shown in FIG. 22 during an overload condition occurring while the step assembly moves from the lowered position to the raised position.

Referring now to FIG. 24, an overload condition during movement of the step assembly 100 from the lowered position to the raised position is described. In situations in which an obstruction impedes movement of the step assembly 100 toward the raised position, retraction of the rod 172 tends to pull the actuator housing 174 and the actuator support 166 in a rearward direction. As the actuator support 166 moves in a rearward direction, the rear spring pin 276 remains engaged with the rear edges of the rear frame fitting slots 268 and 270. As a result, the rear link 284 remains in an essentially fixed position. With the position of the rear link 284 essentially fixed, the movement of the actuator support 166 drives the rear support pin 256 along the rear frame fitting slots 268 and 270 toward the rear spring pin 276.

Still referring to FIG. 24, movement of the actuator support 166, and therefore the forward support pin 254, in a rearward direction pulls on the forward link 280, which in turn moves the forward spring pin 274 in a rearward direction through the forward frame fitting slots 264 and 266. As the forward spring pin 274 moves in a rearward direction, the springs 278 are compressed. Movement of the actuator support 166 in a rearward direction deflects the arm 294 of the switch 290 downward to activate the switch 290.

As previously described, removal of the obstruction allows the step assembly to move to the correct position for the given position of the actuator 168 position. After the obstruction is removed, and the switch 290 is disengaged, the actuator 168 can be manually or automatically enabled.

The above-described overload sensing capability of the step assembly 100 is utilized to turn off the actuator 168 when the step assembly reaches the limits of its normal travel. When the step assembly 100 travels to the lowered position, the step assembly treats the ground as an obstruction impeding further movement. With the step assembly 100 in the lowered position and contacting the ground, further extension of the actuator rod 172 activates the switch 290, which turns off the actuator 168. In this position, the springs 278 bias the step assembly 100 against the ground to increase the stability of the step assembly. Similarly, when the step assembly 100 travels to the raised position, the step assembly treats the stops 208 as obstructions, triggering the switch 290. With the switch 290 triggered, the actuator 168 is turned off, and the springs 278 bias the step assembly 100 against the stops 208 to increase the stability of the step assembly.

Referring now to FIGS. 25-31, an exemplary use of the step assembly 100 in a courtroom setting is disclosed. It should be appreciated that the step assembly is suitable for use in a variety of settings under many different conditions. The use disclosed in FIGS. 25-31 is exemplary only and should not be considered limiting.

Figure 25:
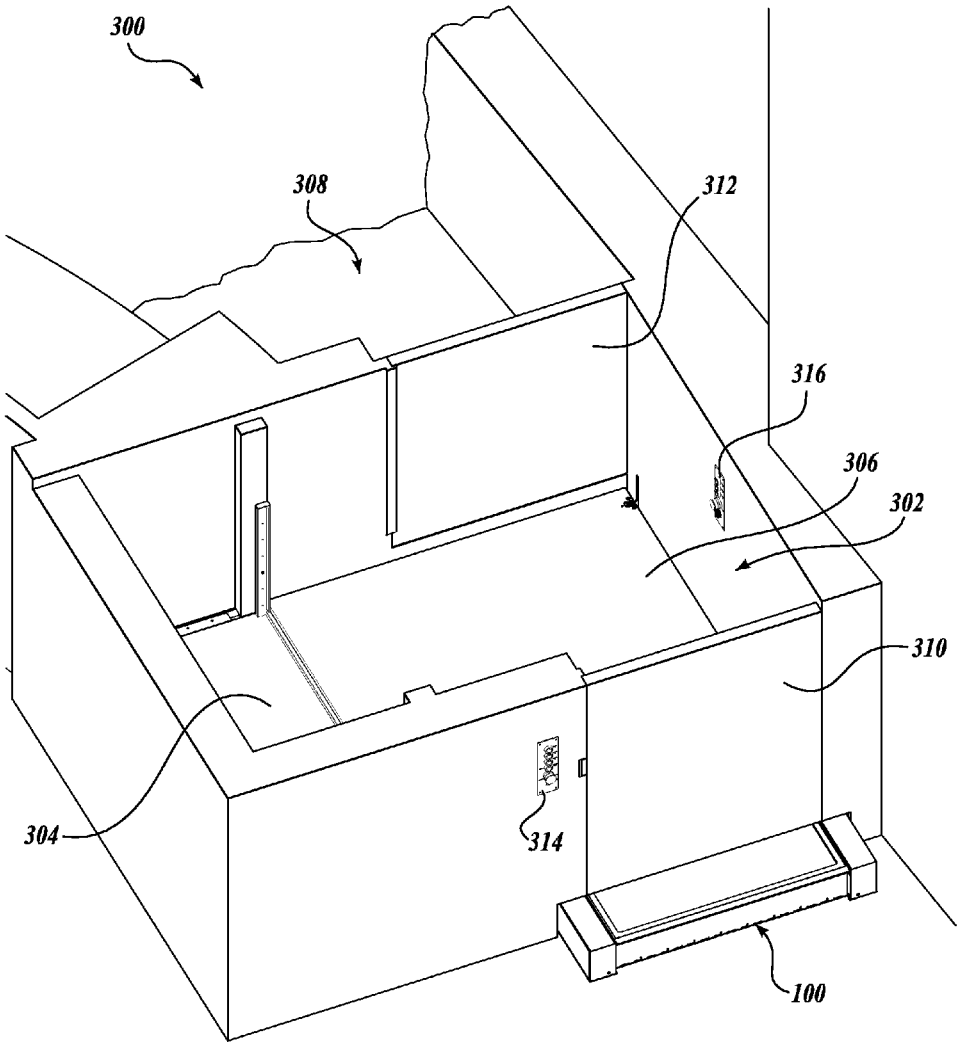
FIG. 25 is an isometric view of an exemplary use of the operable step shown in FIG. 1 with a courtroom witness stand that includes a platform lift, wherein the operable step is in the raised position, and the platform lift is in a parked position.

As shown in FIG. 25, the step assembly 100 is used in conjunction with a courtroom installation 300. The courtroom installation 300 includes a witness area 302 that is elevated above the floor of the courtroom. The witness 302 area has a fixed floor 304 portion and a platform lift 306 portion. Under normal circumstances, the platform lift 306 is in a "parked" position in which the upper surface of the platform lift is level with the fixed floor 304. When so positioned, the platform lift 306 and the fixed floor 304 cooperate to provide a generally flat and level floor to the witness area 302.

Figure 26:
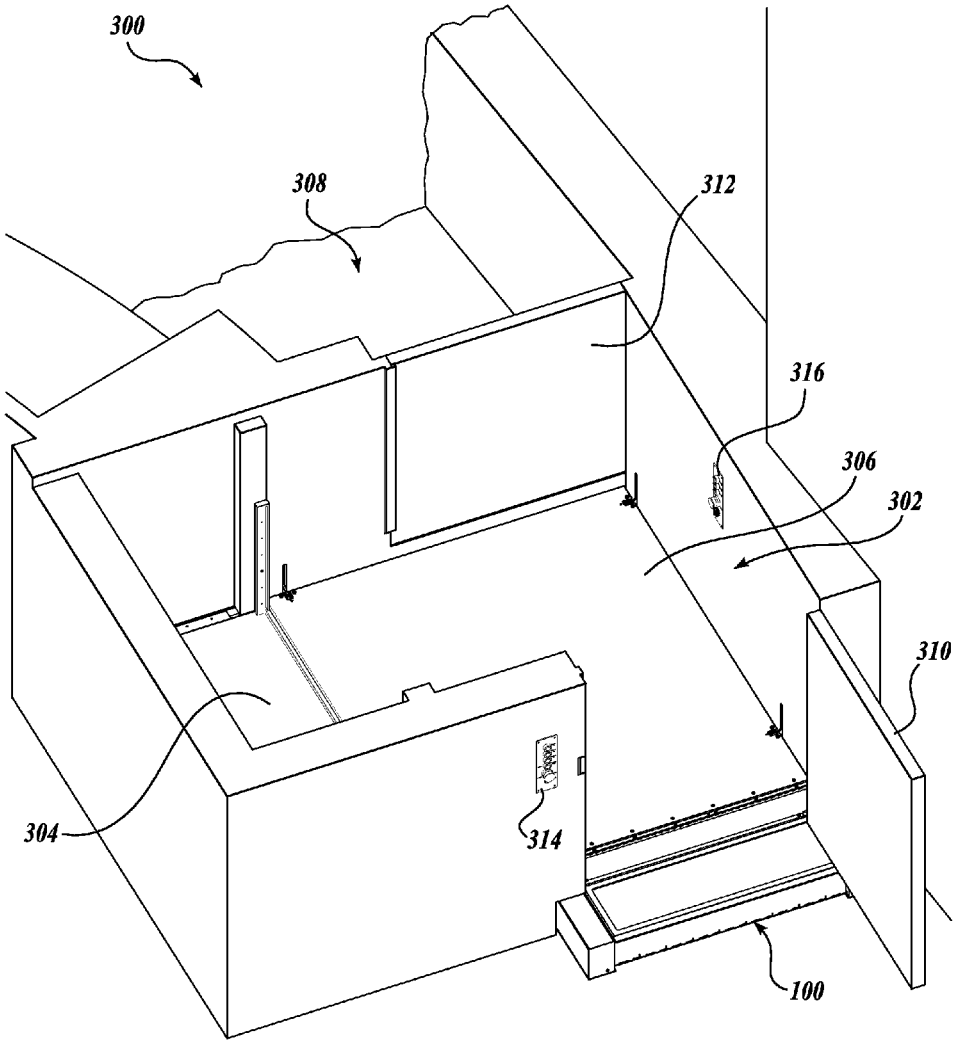
FIG. 26 is an isometric view of the witness stand shown in FIG. 25, wherein the operable step is in the raised position, and the platform lift is in the parked position.
Figure 27:
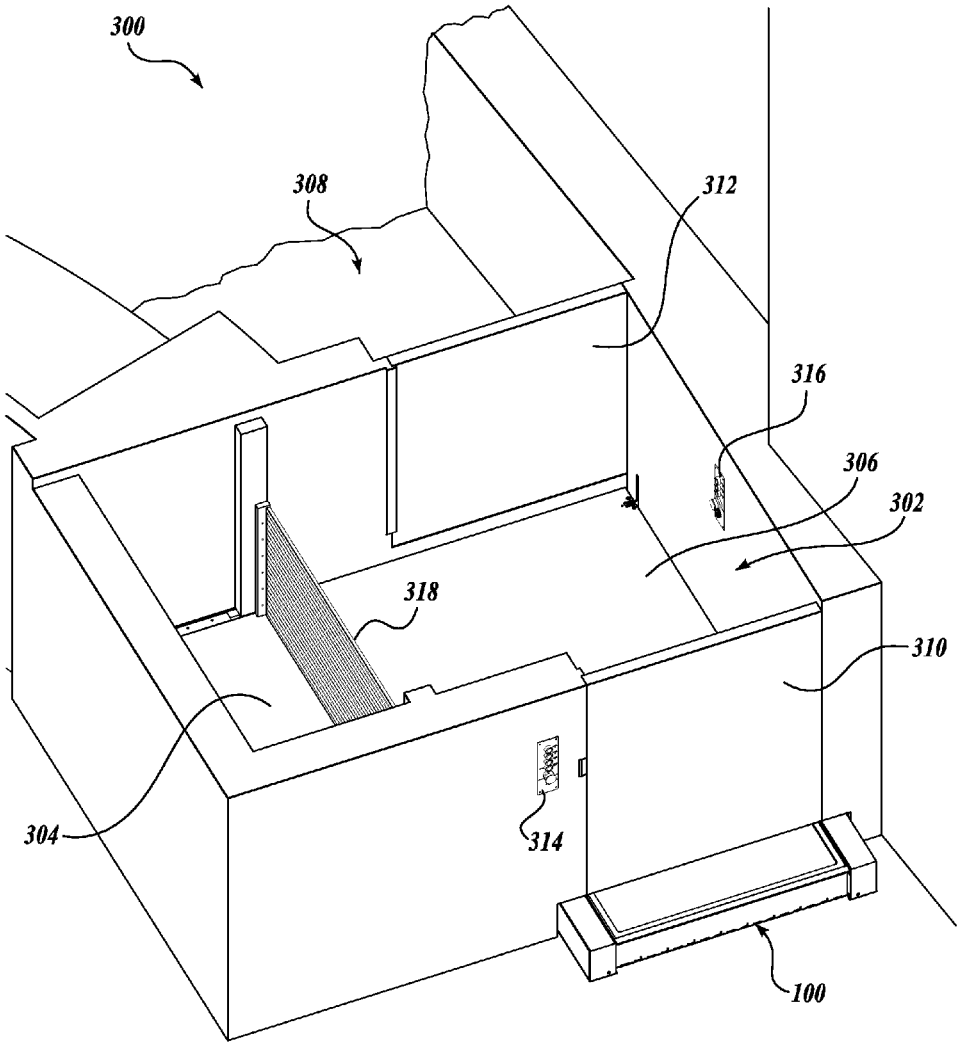
FIG. 27 is an isometric view of the witness stand shown in FIG. 25, wherein the operable step is in the raised position, and the platform lift is in the parked position.

A first door 310 is mounted on one wall of the witness area 302. As shown in FIG. 26, when the door 310 is open and the platform lift 306 is in the parked position, ingress and egress for ambulatory people is provided through the open door. In this position, the operable step 100 is in the raised position to provide a transition step between the witness area 302 and the courtroom floor. A second door is positioned on the opposite wall of the witness area 302 to separate the witness area from the judge's area 308.

To provide mobility-impaired people with ingress to and egress from the witness area 302, the platform lift 306 is moved from the parked position to a lowered position between the parked position and the courthouse floor. To ensure safe operation of the platform lift 306, any time the platform lift 306 is not in the parked position, a moveable barrier 318 is extended upward from the floor of the witness area 302 to separate the platform lift 306 from the fixed floor 304. In addition, both doors 310 and 312 must be closed before the platform lift can be operated. Interlocks are provided to disable the platform lift 306 unless the barrier 318 is extended and both doors 310 and 312 are closed.

Figure 28:
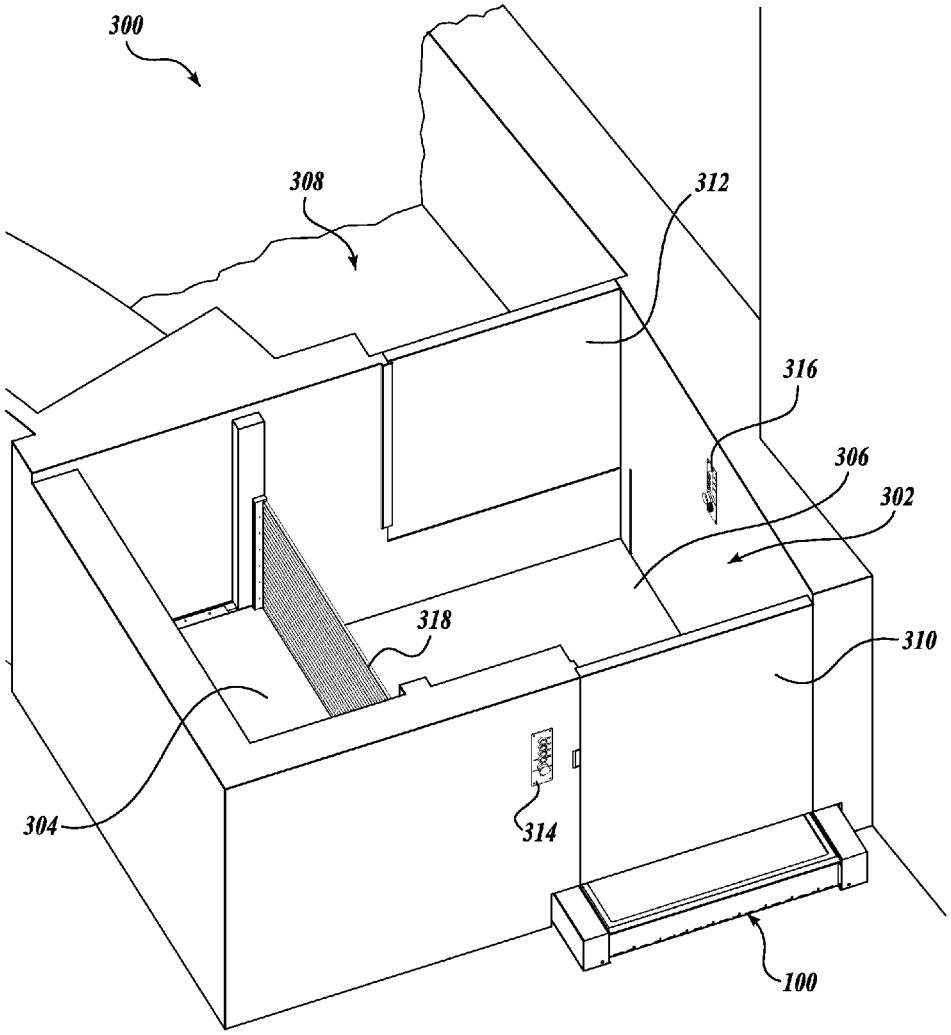
FIG. 28 is an isometric view of the witness stand shown in FIG. 25, wherein the operable step is in the raised position, and the platform lift is in a lowered position.
Figure 29:
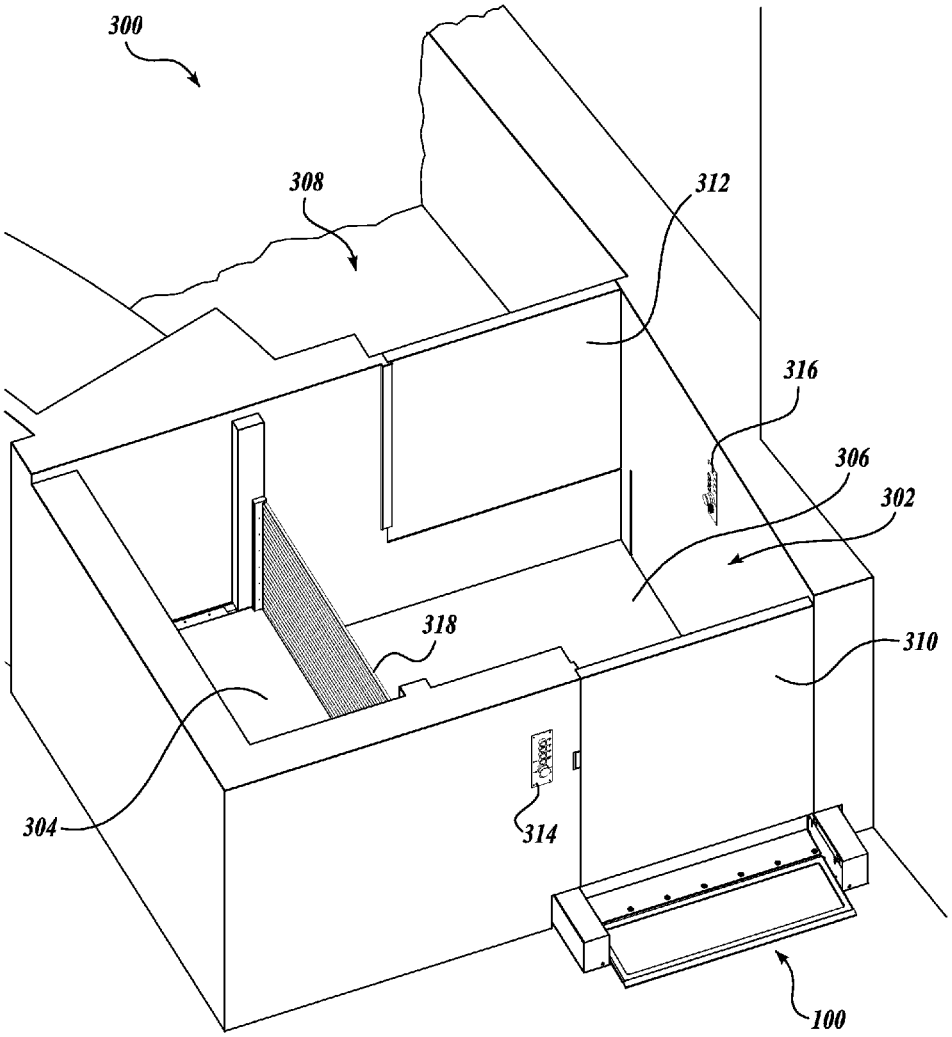
FIG. 29 is an isometric view of the witness stand shown in FIG. 25, wherein the operable step is in the lowered position, and the platform lift is in the lowered position.
Figure 30:
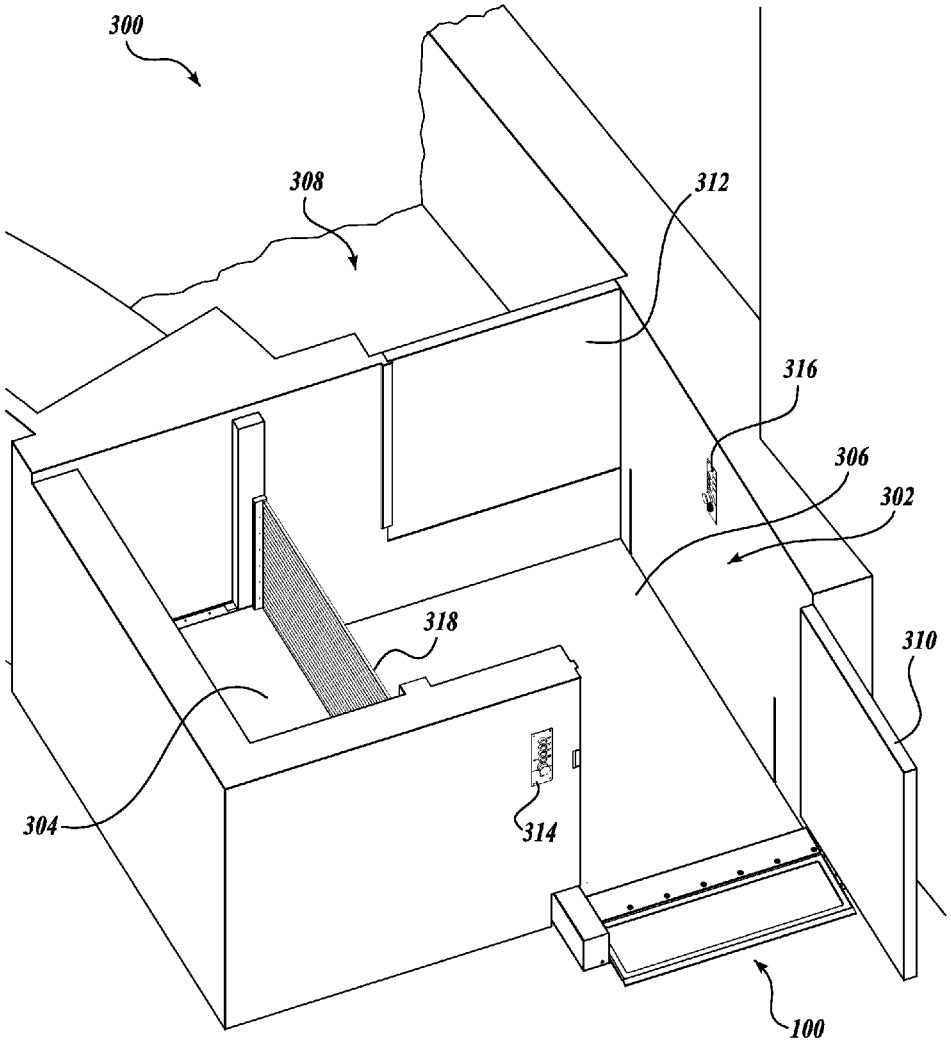
FIG. 30 is an isometric view of the witness stand shown in FIG. 25, wherein the operable step is in the lowered position, and the platform lift is in the lowered position.

With the barrier 318 raised (FIG. 27) the platform lift 306 is moved to its lowered position (FIG. 28). The step assembly 100 is then moved to its lowered (ramp) position to provide a transition surface from the lowered platform lift 306 to the courtroom floor (FIG. 29). With the operable step 100 in the lowered position, the door 310 can be opened to let a mobility-impaired user move into or out of the witness area 302 (FIG. 30).

To return the platform lift 100 to the parked position, the process is reversed. More specifically, (1) the door 310 is closed; (2) the step assembly is returned to its raised position; (3) the platform lift 306 moves up to the parked position; and (4) the barrier 318 retracts into the floor of the witness area 302.

Figure 31:
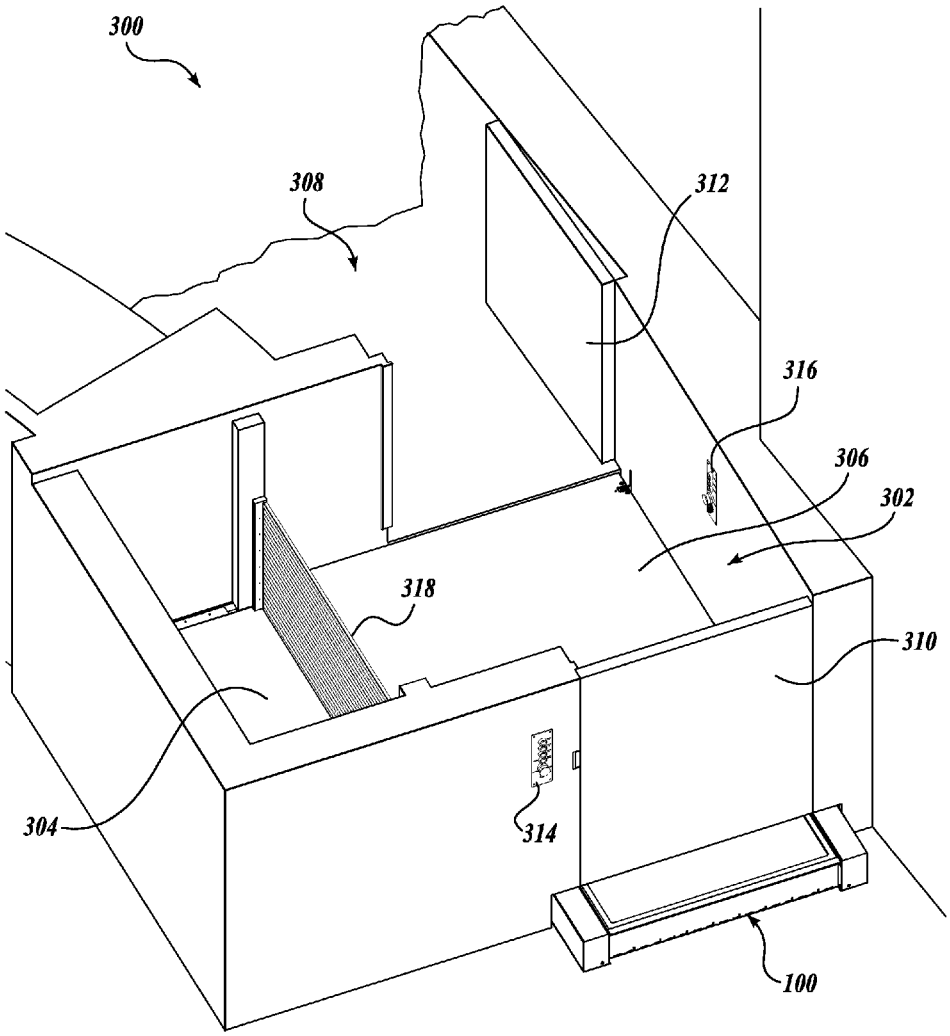
FIG. 31 is an isometric view of the witness stand shown in FIG. 25, wherein the operable step is in the raised position, and the platform lift is in a raised position.

The illustrated courtroom installation 300 also provides ingress to and egress from the judge's area 308 for mobility-impaired people. To enter the judge's area 308, the above-noted steps are followed to put the platform lift 306 and step assembly 100 in the lowered positions (shown in FIG. 30). After a user enters the witness area 302, the door 310 is close, and the platform lift 306 is moved to a raised position in which the upper surface of the platform lift is level with the floor of the judge's area 308. As shown in FIG. 31, opening the second door 312 provides the user with ingress to and egress from the judge's area. To exit the judge's area 308, the process is reversed.

Controls for the courtroom installation 300 are provided on the outside of the witness area (314) inside the witness area (316) and inside the judge's area (not shown). Accordingly, a mobility-impaired person can operate the courtroom installation 300 through the full range of ingress and egress states without assistance.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A step assembly for providing access between an upward facing surface of a lift platform and an alighting surface, the step assembly comprising:

(a) a tread;

(b) a panel rotatably connected to a first end of the tread about a first axis;

(c) a riser rotatably connected to a second end of the tread about a second axis; and (d) an actuator assembly operably coupled to the panel and configured to selectively move the step assembly between a raised position and a lowered position, wherein (1) the tread is substantially horizontal and the panel is orthogonal to the tread when the step assembly is in the raised position; and (2) the tread and the panel define an inclined transition surface extending from the upward facing surface of the lift platform to the alighting surface when the step assembly is in the lowered position, the riser rotating to form an acute angle with the tread when the step assembly moves from the raised position to the lowered position.

2. The step assembly of claim 1, further comprising a support configured to supportingly engage the rotatable connection between the panel and the tread when the step assembly is in the lowered position.

3. The step assembly of claim 1, wherein the riser extends downward from the tread when the step assembly is in the raised position.

4. The step assembly of claim 3, wherein the first axis is disposed along a first edge of the tread, and the second axis is disposed along a second edge of the tread so that the first axis is parallel to the second axis.

5. The step assembly of claim 1, further comprising a base rotatably coupled to the panel, the base maintaining a fixed position relative to the alighting surface.

6. The step assembly of claim 5, wherein the actuator assembly comprises a linear actuator having a first end rotatably associated with the base.

7. The step assembly of claim 6, wherein extension and retraction of the linear actuator rotates the panel in first and second directions, respectively.

8. The step assembly of claim 6, the actuator assembly further comprising:

(a) a first gear rotatably coupled to the base and operably coupled to the linear actuator, the linear actuator being configured to rotate the gear; and (b) a second gear fixedly coupled to the panel and in meshed engagement with the first gear, rotation of the first gear rotating the panel.

9. The step assembly of claim 8, the second gear selectively engaging the base to limit rotation of the panel.

10. The step assembly of claim 5, further comprising a latch assembly, the latch assembly being selectively engageable when the step assembly is in the raised position to prevent movement of the step assembly toward the lowered position.

11. The step assembly of claim 10, the latch assembly comprising (a) a notched fitting fixedly associated with the panel; and (b) a pawl rotatably coupled to the base, the pawl being configured to engage a notch formed in the notched fitting when the step assembly is in the raised position to prevent movement of the step assembly toward the lowered position.

12. The step assembly of claim 11, wherein notched fitting selectively engages the base to limit rotation of the panel.

13. A step assembly for providing access between a lift platform and an alighting surface, an upper surface of the lift platform being moveable between a first elevation and a second elevation, the upper surface being higher at the first elevation than at the second elevation, the step assembly comprising:

(a) a tread;

(b) a panel rotatably coupled to the tread;

(c) a riser rotatably connected to the tread; and (d) an actuator operably coupled to the panel and configured to selectively move the step assembly between a raised position and a lowered position, wherein (1) the tread is substantially horizontal and positioned intermediate to the alighting surface and the upper surface when the step assembly is in the raised position and the lift platform is at the first elevation; and (2) the tread and the panel form a transition surface extending from the alighting surface to the upper surface when the step assembly is in the lowered position and the lift platform is at the second elevation, the riser being disposed under the transition surface when the step assembly in the lowered position.

14. The step assembly of claim 13, wherein the tread forms a predetermined angle with respect to a horizontal plane when the step assembly is in the lowered position.

15. The step assembly of claim 13, further comprising a support configured to supportingly engage the panel and the tread when the step assembly is in the lowered position.

* * * * *

UNITED STATES PATENT AND TRADEMARK OFFICE

CERTIFICATE OF CORRECTION

PATENT NO. : 8,631,529 B1
APPLICATION NO. : 13/668096
DATED : January 21, 2014
INVENTOR(S) : D. Johnson et al.

It is certified that error appears in the above-identified patent and that said Letters Patent is hereby corrected as shown below:

| COLUMN | LINE | ERROR |
|---|---|---|
| Title Page item (73) | Assignee | "**Lift-U, division of Hogan Mfg., Inc.,**" should read **--Lift-U, Division of Hogan Mfg., Inc.,--** |
| In the Claims Col. 14 (Claim 13, | 48 line 21) | after "assembly" insert --is-- |

Signed and Sealed this
Fourth Day of November, 2014

Michelle K. Lee

Michelle K. Lee
*Deputy Director of the United States Patent and Trademark Office*